United States Patent [19]

Castegnier et al.

[11] Patent Number: 4,895,629

[45] Date of Patent: Jan. 23, 1990

[54] SPEED ELECTROCOAGULATION PRINTING METHOD AND APPARATUS

[75] Inventors: Adrien Castegnier, Outremont; Guy Castegnier, Ile Bizard; Francoise Castegnier, Outremont; Gilles Gadbois, Rawndon, all of Canada

[73] Assignee: Elcorsy Inc., Montreal, Canada

[21] Appl. No.: 342,101

[22] Filed: Apr. 24, 1989

[51] Int. Cl.[4] ..... C25D 13/04

[52] U.S. Cl. ..... 204/180.9; 204/181.1; 204/300 EC

[58] Field of Search ..... 204/180.1, 180.9, 181.1, 204/300 EC

[56] References Cited

U.S. PATENT DOCUMENTS

| | | | |
|---|---|---|---|
| 3,892,645 | 7/1975 | Castegnier | 204/180.2 |
| 4,555,320 | 11/1985 | Castegnier | 204/180.9 |
| 4,661,222 | 4/1987 | Castegnier | 204/180.9 |
| 4,680,097 | 7/1987 | Castegnier | 204/180.1 |
| 4,786,385 | 11/1988 | Castegnier | 204/180.1 |

*Primary Examiner*—T. M. Tufariello
*Attorney, Agent, or Firm*—Swabey Ogilvy Renault

[57] ABSTRACT

A method and apparatus for reproducing an image and transferring same onto a substrate. A positive cylindrical electrode is rotated about its longitudinal axis at a substantially constant speed, the positive electrode having a passivated surface defining a positive electrode active surface. A plurality of negative electrolytically inert electrodes electrically insulated from one another are arranged in rectilinear alignment to define a series of corresponding negative electrode active surface disposed in a plane parallel to the longitudinal axis of the positive electrode and spaced from the positive electrode active surface by a constant predetermined gap, the negative electrodes being spaced from one another by a distance at least equal to the electrode gap to prevent edge corrosion of the negative electrodes. The positive electrode active surface is coated with an olefinic substance and a metal oxide to form thereon microdroplets of olefinic substance containing the metal oxide in an amount to prevent corrosion of the positive electrode. The electrode gap is filled with a colloidal dispersion containing an electrolytically coagulable colloid. Selected ones of the negative electrodes are electrically energized to cause point-by-point selective coagulation and adherence of the colloid onto the olefin and metal oxide-coated positive electrode active surface, thereby forming a series of corresponding dots of colored, coagulated colloid representative of a desired image. The dots of colored, coagulated colloid are then contacted with a substrate to cause transfer of the colored, coagulated colloid onto the substrate and thereby imprint the substrate with the image.

65 Claims, 15 Drawing Sheets

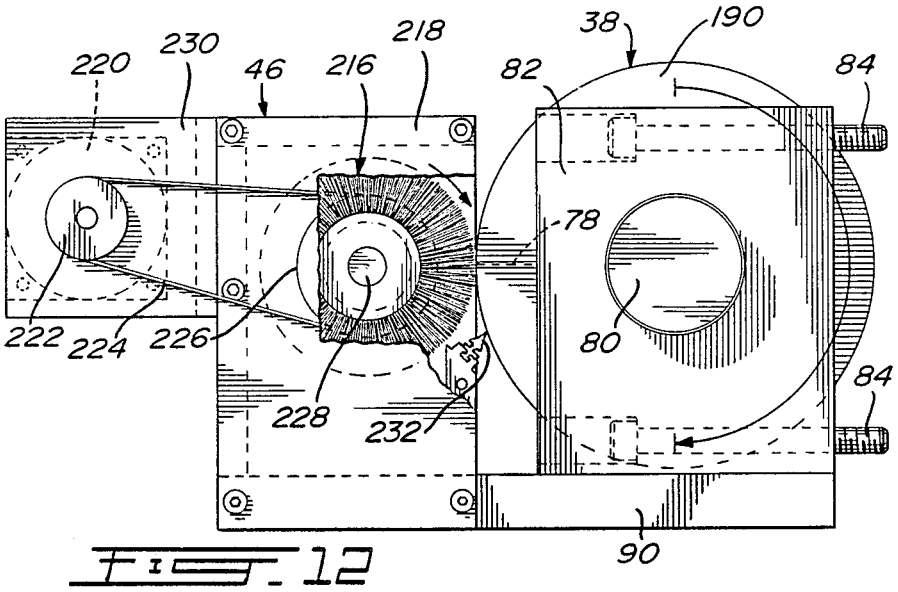
FIG. 12
FIG. 5
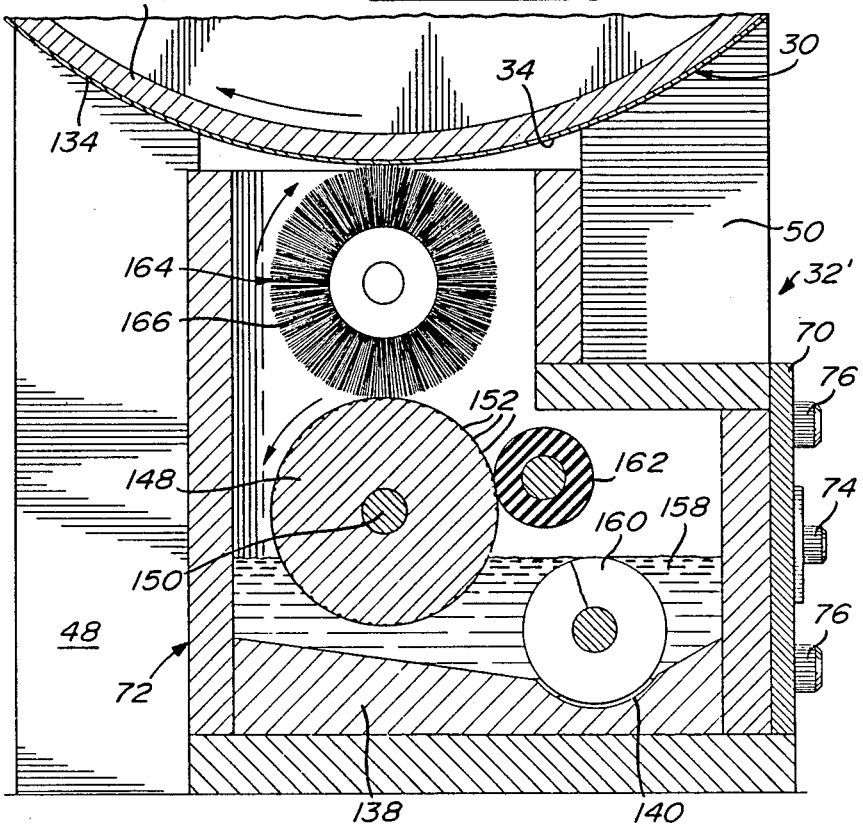

316
350

324d
324
324b
354d
354b
314
354b
315
354d
352b
343
353
352d
355d
342
355b
316
355b
355d
328
328
326
326
317
318

SPEED ELECTROCOAGULATION PRINTING METHOD AND APPARATUS

BACKGROUND OF THE INVENTION

The present invention relates to improvements in the field of high-speed dynamic printing. More particularly, the invention is concerned with an improved electrocoagulation printing method and apparatus wherein dots of electrocoagulated colloid representative of an image are transferred onto a substrate, such as paper.

Applicant has already described in his U.S. Pat. No. 4,661,222 of Apr. 28, 1987 an electrocoagulation printing method and apparatus in which use is made of a positive electrode in the form of a moving endless belt onto which dots of colored, coagulated colloid representative of an image are produced. These dots of colored, coagulated colloid are thereafter contacted with a substrate to cause transfer of the coloring agent used for coloring the colloid onto the substrate and thereby imprint the substrate with the image. As explained in this patent, the coloring of the colloid is effected either before or after the coagulation thereof depending on whether the coloring agent used is a pigment or a dye. Where the coloring agent is a pigment, the coloring of the colloid is effected prior to coagulation and the dots of colored, coagulated colloid obtained upon coagulation of the colored colloid must be treated with a colloid softening agent so as to maintain the colored, coagulated colloid in a softened state for enabling the pigment to be subsequently transferred onto the substrate. In the case where the coloring agent is a dye, the coloring of the colloid is effected after coagulation by applying to the dots of coagulated colloid a liquid coloring medium containing the dye, thereby obtaining the desired dots of colored, coagulated colloid. In this case, however, the substrate must be coated with a wetting agent which is a solvent of the dye for enabling the dye to be transferred onto the substrate and, depending on the type of substrate used, further treatment may be necessary. For instance, if gelatinized paper is used, the wetting agent must also act as a gelatin softening agent for conditioning the gelatinized paper to receive the dye. If bond paper or synthetic resin-coated or kaolin-coated paper or the like is used, the coloring medium must further contain a colloid softening agent so as to maintain the colored, coagulated colloid in a softened state and thus allow transfer of the dye onto such type of substrate.

Since the coloring agent is transferred onto the substrate, the period of contact between the dots of colored, coagulated colloid and the substrate must be sufficiently long to enable all of the coloring agent to be transferred onto the substrate. Such a transfer generally takes about 1 second. Where the coloring agent used is a dye, sufficient time must also be alloted for the dots of coagulated colloid to absorb the dye. Thus, it may take up to 3 seconds from the time the dye is applied to the dots of coagulated colloid till complete transfer of the dye onto the substrate. Use of a substrate coated with a wetting agent such as an alcohol wetted paper for enabling the dye to be transferred also causes difficulties in superimposing with precision images of different colors.

Moreover, since the negative electrodes are generally energized more than once in the reproduction of an image, these become polarized resulting in secondary electrolytic reactions causing the generation of gas bubbles which remain trapped at the interface of the negative electrodes and thus adversely affect the image reproduction. Edge corrosion of the negative electrodes has also been observed upon repeated electrocoagulation, necessitating replacement of the electrodes every 1000 printed copies.

The problem of undesirable gas generation at the negative electrodes has been solved by Applicant in his U.S. Pat. No. 4,680,097 of July 14, 1987. According to the teaching of this patent, undesirable gas generation and accumulation at the negative electrodes is prevented by coating the positive electrode with an olefinic substance prior to electrically energizing the electrodes such that upon electrical energization gas generated as a result of electrolysis is consumed by reaction with the olefinic substance; such a reaction must however be carried out in the presence of a metal oxide which acts as a catalyst and which is either already present as a surface layer on the positive electrode or is admixed with the olefinic substance. Coating of the positive electrode with an olefinic substance has also been found to weaken the adherence of the dots of coagulated colloid to the positive electrode, thereby permitting transfer of the coagulated colloid onto the substrate upon contact therewith. However, there still remained the problem of edge corrosion of the negative electrodes.

When applying the technology of the above patent to high-speed electrocoagulation printing and using a positive electrode in the form of a revolving cylinder instead of a moving endless belt to increase the speed of transfer of the coagulated colloid, Applicant was faced with still another problem: corrosion of the positive electrode creating undesirable marking of the electrode surface and adversely affecting the image reproduction.

SUMMARY OF THE INVENTION

It is therefore an object of the present invention to overcome the above drawbacks and to provide a high-speed electrocoagulation printing method and apparatus, in which corrosion of the positive electrode as well as edge corrosion of the negative electrodes are eliminated.

According to one aspect of the invention, there is provided a method of reproducing an image and transferring same onto a substrate, which comprises the steps of:

(a) providing a positive cylindrical electrode having a central longitudinal axis and rotating at substantially constant speed about its longitudinal axis, the positive electrode being formed of an electrolytically inert metal and having a passivated surface defining a positive electrode active surface, and a plurality of negative electrolytically inert electrodes electrically insulated from one another and arranged in rectilinear alignment to define a series of corresponding negative electrode active surfaces disposed in a plane parallel to the longitudinal axis of the positive electrode and spaced from the positive electrode active surface by a constant predetermined gap, the negative electrodes being spaced from one another by a distance at least equal to the electrode gap to prevent edge corrosion of the negative electrodes;

(b) coating the positive electrode active surface with an olefinic substance and a metal oxide to form on the surface micro-droplets of olefinic substance containing the metal oxide in an amount to prevent corrosion of the positive electrode;

(c) filling the electrode gap with a substantially liquid colloidal dispersion containing an electrolytically coagulable colloid, a liquid dispersing medium, a soluble electrolyte and a coloring agent, and having a substantially constant temperature;

(d) electrically energizing selected ones of the negative electrodes to cause point-by-point selective coagulation and adherence of the colloid onto the olefin opposite the electrode active surfaces of the energized negative electrodes while the positive electrode is rotating, thereby forming a series of corresponding dots of colored, coagulated colloid representative of a desired image;

(e) removing any remaining non-coagulated colloid from the positive electrode active surface; and (f) contacting the dots of colored, coagulated colloid with a substrate at a transfer position to cause transfer of the colored, coagulated colloid onto the substrate and thereby imprint the substrate with the image.

The present invention also provides, in a further aspect thereof, an apparatus for carrying out a method as defined above. The apparatus of the invention comprises:

a positive cylindrical electrode having a central longitudinal axis and a passivated surface defining a positive electrode active surface, the positive electrode being formed of an electrolytically inert metal;

means for rotating the positive electrode about its longitudinal axis at a substantially constant speed;

a plurality of negative electrolytically inert electrodes electrically insulated from one another and arranged in rectilinear alignment to define a series of corresponding negative electrode active surfaces disposed in a plane parallel to the longitudinal axis of the positive electrode and spaced from the positive electrode active surface by a constant predetermined gap, the negative electrodes being spaced from one another by a distance at least equal to the electrode gap to prevent edge corrosion of the negative electrodes;

means for coating the positive electrode active surface with an olefinic substance and a metal oxide to form on the surface micro-droplets of olefinic substance containing the metal oxide in an amount to prevent corrosion of the positive electrode;

means for filling the electrode gap with a substantially liquid colloidal dispersion containing an electrolytically coagulable colloid, a liquid dispersing medium, a soluble electrolyte and a coloring agent, and having a substantially constant temperature;

means for electrically energizing selected ones of the negative electrodes to cause point-by-point selective coagulation and adherence of the colloid onto the olefin and metal oxide-coated positive electrode active surface opposite the electrode active surfaces of the energized negative electrodes while the positive electrode is rotating, thereby forming a series of corresponding dots of colored, coagulated colloid representative of a desired image;

means for removing any remaining non-coagulated colloid from the positive electrode active surface; and means for bringing a substrate into contact with the dots of colored, coagulated colloid at a transfer station to cause transfer of the colored, coagulated colloid onto the substrate and thereby imprint the substrate support with the image.

It has been surprisingly found, according to the invention, that by spacing the negative electrodes a distance which is equal to or greater than the electrode gap, edge corrosion of the negative electrodes is prevented. On the other hand, the use of a positive electrode having a passivated surface and the coating thereof with an olefinic substance and a metal oxide have been found to prevent corrosion of the positive electrode. Contrary to the teaching of Applicant's U.S. Pat. No. 4,680,097, according to which no additional metal oxide is necessary when the positive electrode utilized already has a metal oxide surface layer, the latter being sufficient to act as catalyst for the desired reaction, it has now been found that it is essential to use a metal oxide with a positive electrode having a passivated surface, i.e., having a metal oxide surface layer or an adsorbed oxygen surface layer. For instance, in the case of stainless steel which is an alloy, it is believed that such an alloy has an adsorbed oxygen surface layer rather than a chromium oxide surface layer as previously stated in Applicant's U.S. Pat. No. 4,661,222, which defines a passive surface layer. This may explain why no corrosion of the positive electrode was observed with the endless belt of stainless steel described in U.S. Pat. No. 4,661,222, since due to the length of the belt the positive electrode active surface defined by the surface of the belt has sufficient time to re-passivate itself. This is not the case with a positive electrode in the form of revolving cylinder which has a much smaller surface and there is thus not enough time for the surface to re-passivate itself, which may account for the observed corrosion of the cylindrical electrode. It is therefore necessary according to the invention to apply onto the surface of such an electrode not only an olefinic substance but also a metal oxide.

Examples of suitable electrolytically inert metals from which the positive and negative electrodes can be made are stainless steel, platinum, chromium, nickel, aluminum and tin stainless steel being preferred.

The positive electrode can be in the form of a solid cylinder, but preferably comprises a pliable sheet of electrolytically inert metal having a passive surface layer and extending on a tubular support member having a cylindrical surface, the metal sheet being held in tight contact engagement with the surface of the support member to conform therewith and thereby have a surface of cylindrical configuration defining the positive electrode active surface. The provision of such a metal sheet held on a tubular support member enables the positive electrode to be replaced at relatively low cost since only the metal sheet requires replacement.

The gap which is defined between the positive and negative electrodes can range from about 50μ to about 100μ, the smaller the electrode gap the sharper are the dots of coagulated colloid produced. Where the electrode gap is of the order of 50μ, the negative electrodes are the preferably spaced from one another by a distance of about 75μ.

Examples of suitable olefinic substances which may be used to coat the surface of the positive electrode include unsaturated fatty acids such as arachidonic acid, linoleic acid, linolenic acid, oleic acid and palmitoleic acid, unsaturated vegetable oils such as corn oil, linseed oil, olive oil, peanut oil, soybean oil and sunflower oil, and unsaturated vegetable waxes such as carnauba wax. The olefinic substance is advantageously applied onto the positive electrode active surface in the form of a dispersion containing the metal oxide as dispersed phase, such a dispersion being preferably applied in an amount such as to form micro-droplets having a size ranging from about 1 to about 5μ. Examples of suitable metal oxides which can be used according to the invention include aluminum oxide, ceric oxide, chromium oxide, cupric oxide, cuprous oxide, ferric oxide, ferrous oxide, lead oxide, magnesium oxide, manganese oxide, titanium dioxide and zinc oxide; chromium oxide is the preferred metal oxide. Depending on the type of metal oxide used, the amount of metal oxide may range from about 20 to about 60% by weight, based on the total weight of the dispersion. Preferably, the olefinic substance and the metal oxide are present in the dispersion in substantially equal amounts. According to a preferred embodiment, the olefinic substance comprises a mixture of an unsaturated fatty acid, e.g. oleic acid, and an unsaturated vegetable wax, e.g. carnauba wax, which forms a flowable paste. A particularly preferred dispersion contains about 47 wt. % of oleic acid, about 6 wt. % of carnauba wax and about 47 wt. % of chromium oxide; the use of such a dispersion enables one to print over 10,000 copies without noticeable corrosion of the positive electrode.

The dispersion containing the olefinic substance and the metal oxide is advantageously applied onto the positive electrode active surface by means of a device comprising a rotatable brush provided with a plurality of radially extending bristles having extremities contacting the positive electrode active surface, means for applying a predetermined amount of the dispersion onto the bristles to coat the extremities thereof, and drive means for rotating the brush to cause the coated bristles to transfer the dispersion onto the positive electrode active surface and thereby form the desired microdroplets of olefinic substance containing the metal oxide. The bristles are preferably made of horsehair as these have been found to provide micro-droplets of substantially uniform size distribution. In a preferred embodiment, the means for applying a predetermined amount of the dispersion onto the bristles comprises a roller arranged in spaced-apart parallel relation to the brush such as to contact the bristles thereof at their extremities, the roller being partially immersed in a bath containing the dispersion and being formed with a plurality of longitudinally extending grooves adapted to be filled with the dispersion, means for removing excess dispersion from the roller, and further drive means for rotating the roller in the dispersion whereby the grooves thereon are filled with the dispersion and the dispersion is transferred to the bristles to coat same. The further driver means preferably comprises a variable speed motor for varying the speed of rotation of the roller to thereby vary the amount of dispersion applied onto the bristles of the brush.

Instead of a rotable brush, it is also possible to use a roller provided with a plurality of radially extending strips of cloth-like material adapted to contact the positive electrode active surface, the strips being coated with a predetermined amount of dispersion by the aforesaid means. A drive means is provided for rotating the roller to cause the coated strips to impinge upon the positive electrode active surface such as to transfer thereon the dispersion and thereby form the desired micro-droplets. The strips of cloth-like material are preferably made of chamois leather since such strips have been found to provide micro-droplets having a substantially uniform size distribution.

According to a preferred embodiment, the colloidal dispersion is continuously injected under pressure into the electrode gap, in a direction substantially tangent to the positive electrode active surface, to thereby completely fill the electrode gap. In order to provide a uniform supply and distribution of colloid, the colloidal dispersion is preferably discharged in the form of jets from a plurality of spaced-apart fluid discharge orifices arranged along a line parallel to the longitudinal axis of the positive electrode.

The colloid generally used is a linear colloid of high molecular weight, that is, one having a molecular weight comprised between about 10,000 and about 1,000,000, preferably between 100,000 and 600,000. Examples of suitable colloids include natural polymers such as albumin, gelatin, casein and agar, and synthetic polymers such as polyacrylic acid, polyacrylamide and polyvinyl alcohol. A particularly preferred colloid is an anionic copolymer of acrylamide and acrylic acid having a molecular weight of about 250,000 and sold under the trade mark ACCOSTRENGTH 86 by Cyanamid Inc. Water is preferably used as the medium for dispersing the colloid to provide the desired colloidal dispersion.

The colloidal dispersion also contains a soluble electrolyte and a coloring agent, the electrolyte enabling the water to have a greater conductivity. Examples of suitable electrolytes include chlorides and sulfates, such as lithium chloride, sodium chloride, potassium chloride, calcium chloride, nickel chloride, copper chloride, ammonium chloride and manganese sulfate. The coloring agent can be a dye or a pigment. Examples of suitable dyes which may be used to color the colloid are the water soluble dyes available from HOECHST such as Duasyn Acid Black for coloring in black and Duasyn Acid Blue for coloring in cyan, or those available from RIEDEL-DEHAEN such as Anti-Halo Dye Blue T. Pina for coloring in cyan, Anti-Halo Dye AC Magenta Extra V01 Pina for coloring in magenta and Anti-Halo Dye Oxonol Yellow N. Pina for coloring in yellow. When using a pigment as a coloring agent, use can be made of the pigments which are available from CABOT CORP. such as Carbon Black Monarch® 120 for coloring in black, or those available from HOECHST such as Colanyl Black or Flexonyl Black for coloring in black, Colanyl Blue, Flexonyl Blue or Hostaperm Blue for coloring in cyan, Colanyl Violet, Flexonyl Violet or Flexonyl Rubbim for coloring in magenta and Colanyl Yellow, Flexonyl Yellow or Permanent Yellow for coloring in yellow. Since the speed of electrocoagulttion is affected by temperature, the colloidal dispersion must be maintained at a substantially constant temperature in order to ensure a uniform image reproduction.

In order to increase the speed of electrical energizing of the negative electrodes, the negative electrodes preferably define a predetermined number of channels each having an equal number of negative electrodes and the selective energizing thereof is effected by sequentially scanning the electrodes of each channel while performing such a scanning simultaneously for all channels, and applying an electrical signal to selected ones of the negative electrodes during scanning to energize same. Preferably, the electrical signal is a pulse-modulated signal having a pulse duration which may vary from about 250 nanoseconds to about 4 microseconds so as to vary the amount of coagulated colloid and thereby form dots of coagulated colloid of varying intensities, enabling the half-tones of an image to be reproduced.

According to a preferred embodiment, the negative electrodes are arranged in at least one elongated head along the length thereof, the head having a longitudinal axis and being rotatable about the longitudinal axis thereof for moving the negative electrodes between a first position whereat the negative electrode active surfaces are spaced from the positive electrode active surface by the constant predetermined gap and a second position whereat the negative electrode active surfaces are exposed to permit cleaning thereof. Preferably, use is made of two such heads arranged in juxtaposed relation to one another to increase the resolution of the image up to about 160,000 dots per square inch.

After coagulation of the colloid, any remaining non-coagulated colloid is removed from the positive electrode active surface, for example, by scraping the surface with a soft rubber squeegee, so as to fully uncover the colored, coagulated colloid.

When a polychromic image is desired, steps (a) through (f) of the method according to the invention are repeated several times to define a corresponding number of printing stages each using a coloring agent of different color and to thereby produce several differently colored images of coagulated colloid which are transferred at respective transfer positions onto the substrate in superimposed relation to provide the desired polychromic image. In a preferred embodiment, the printing stages are arranged around a single roller adapted to bring the substrate into contact with the dots of colored, coagulated colloid of each printing stage, and the substrate is in the form of a continuous web which is partially wrapped around the roller and passed through the respective transfer positions for being imprinted with the colored images at the printing stages. It is also possible to arrange the printing stages in tandem relation and to pass the web through the respective transfer positions so as to imprint the web with the colored images at the printing stages. Such a continuous web can have a travelling speed of up to 3 feet per second.

The printing method and apparatus according to the invention enables one to produce per print of 11×12 inch about 5,280,000 dots of colored, coagulated colloid of varying intensities per color with a resolution of about 40,000 dots per square inch and to provide a printed copy at a rate of up to three copies every second, with either a monochromic or polychromic image.

BRIEF DESCRIPTION OF THE DRAWINGS

Further features and advantages of the invention will become more readily apparent from the following description of preferred embodiments as illustrated by way of examples in the accompanying drawings, in which:

FIG. 5 is a view similar to FIG. 3, but illustrating a different embodiment;

FIG. 12 which is on the same sheet of drawings as FIG. 5 is a side view showing the negative electrode cleaning unit used for cleaning the surfaces of the negative electrodes arranged in a printing head;

DESCRIPTION OF PREFERRED EMBODIMENTS

Figure 1:
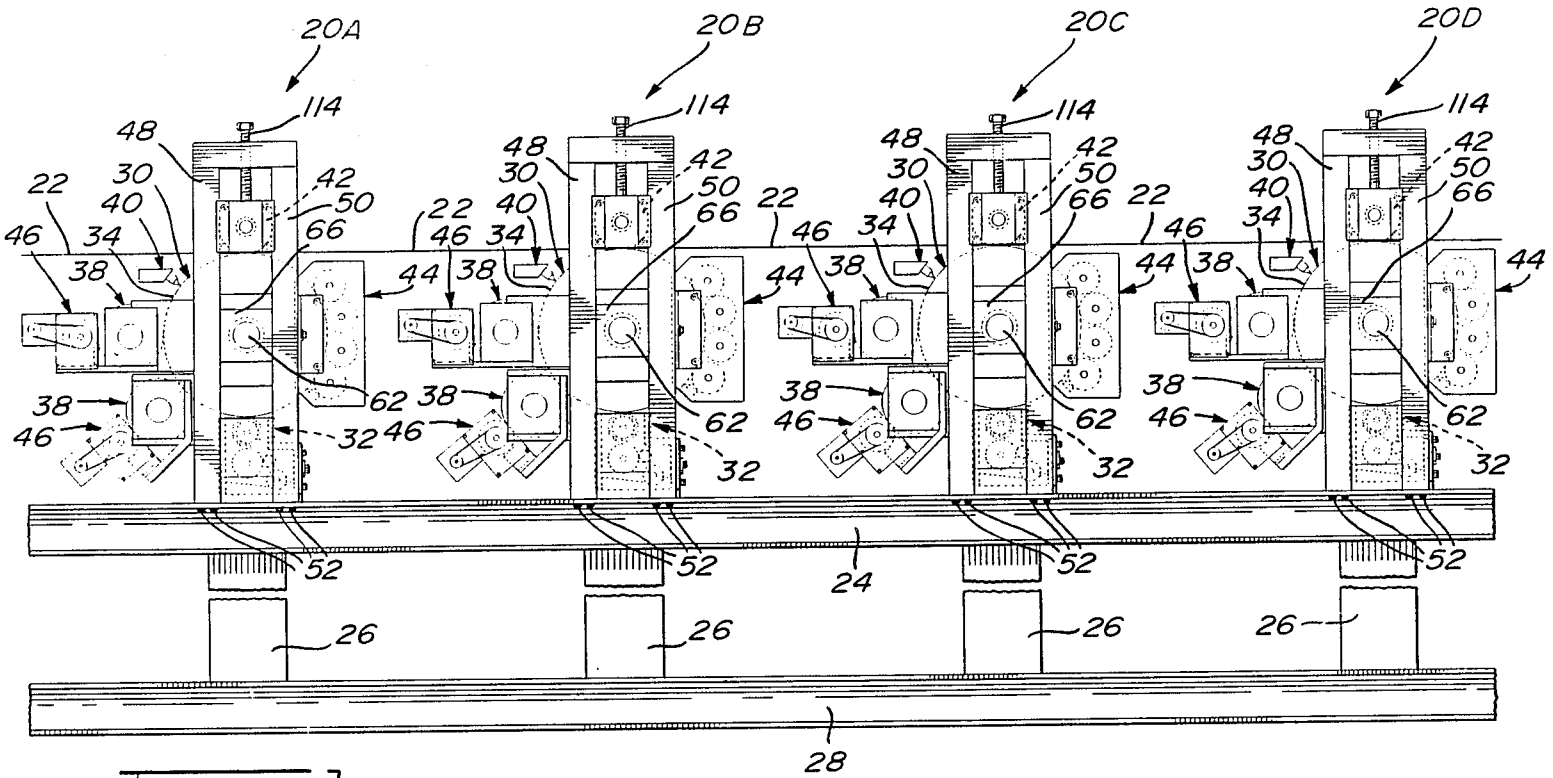
FIG. 1 is a side elevation view of an electro-coagulation printing apparatus according to a preferred embodiment of the invention, comprising four printing towers each using a coloring agent of different color.

Referring first to FIG. 1, there is illustrated an electrocoagulation printing apparatus comprising four identical printing towers 20 arranged in tandem relation, but each using a coloring agent of different color. In the embodiment shown, the first printing tower 20A at the left of the figure is adapted to print in black color, the second printing tower 20B in cyan color, the third printing tower 20C in magenta color and the fourth printing tower 20D in yellow color. A substrate in the form of a continuous web 22 is fed to the printing towers 20 for being imprinted with differently colored images which are transferred onto the web in superimposed relation to provide a polychromic image. The printing towers 20 are mounted on a pair of spaced-apart parallel I-beams 24 (only one shown) which are supported at a predetermined height by a plurality of columns 26; the 10 columns can be fastened to another pair of spaced-apart parallel I-beams 28 (only one shown) defining a base, or they can be bolted directly to the floor.

Figure 2:
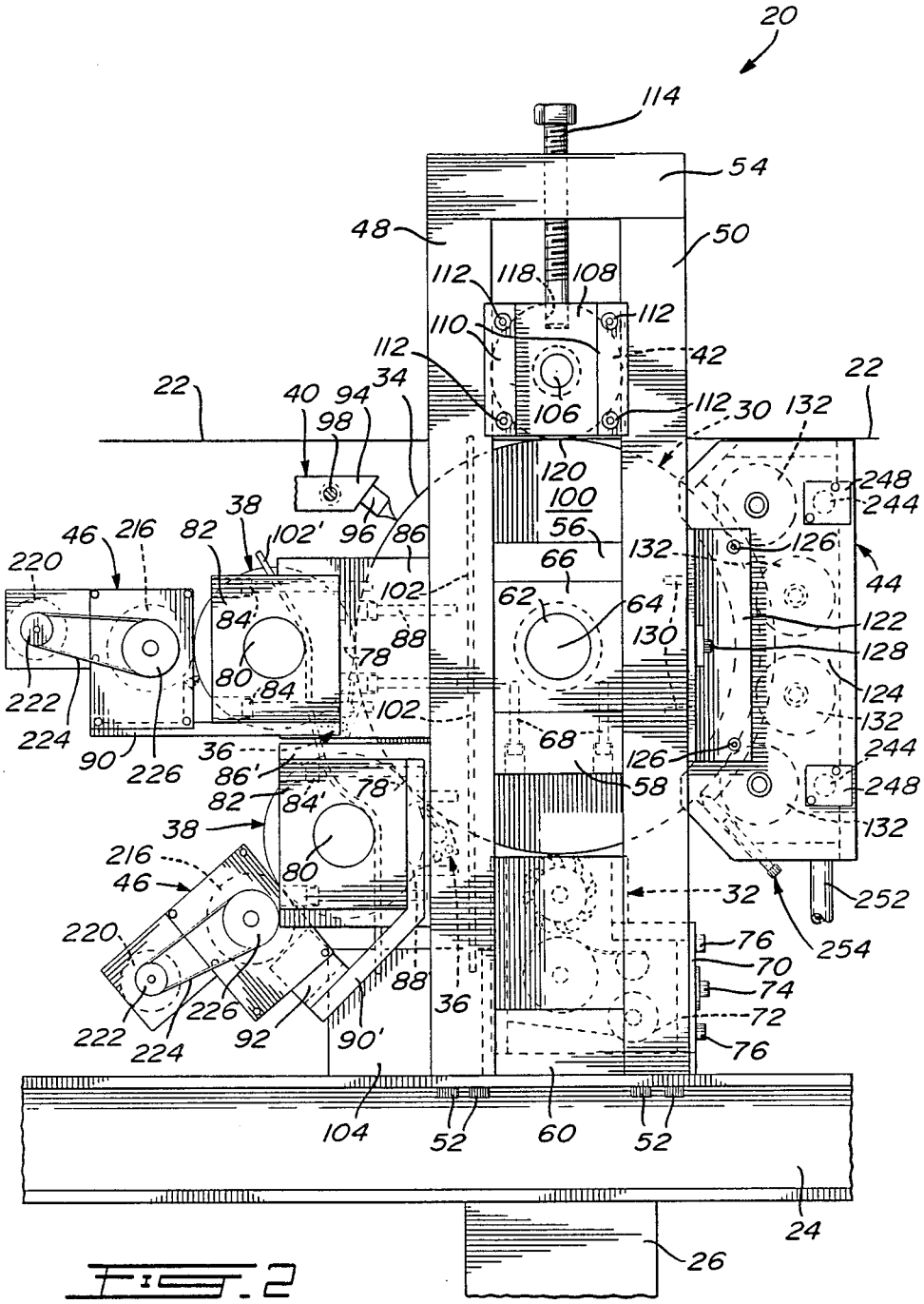
FIG. 2 is a side elevation view of one of the printing towers illustrated in FIG. 1, showing details thereof.

As best shown in FIG. 2, the printing towers 20 each comprise a positive electrode 30 in the form of a revolving cylinder, a positive electrode coating unit 32 for coating the surface 34 of the positive electrode with an olefinic substance and a metal oxide, two colloid injectors 36, a pair of juxtaposed printing heads 38 provided with negative electrodes for electrocoagulating the colloid to form on the positive electrode active surface 34 dots of colored, coagulated colloid representative of a desired image and a device 40 for removing any remaining non-coagulated colloid from the surface 34. Each printing tower 20 further includes a pressure roller 42 for bringing the web 22 into contact with the dots of colored, coagulated colloid to cause transfer of the colored, coagulated colloid onto the web 22 and thereby imprint the web with the image, and a positive electrode cleaning unit 44 for cleaning the surface 34 and thus removing any remaining coagulated colloid from the surface after transfer of the dots of colored, coagulated colloid onto the web 22. A negative electrode cleaning unit 46 is also provided for cleaning the surfaces of the negative electrodes arranged in each printing head 38.

The positive electrode 30 is mounted between two opposite pairs of vertically extending frame members 48 and 50 (only one pair shown) which are fixed to the I-beams 24 by bolts 52, the frame members 48 and 50 being interconnected by four horizontally extending frame members 54, 56, 58 and 60. The cylindrical electrode 30 has a shaft 62 which is driven by a motor (not shown) for rotating the electrode about its central longitudinal axis 64 at a substantially constant speed. The shaft 62 extends at each end thereof through a support bracket 66 which is arranged between the frame members 56,58 and fixed to the frame member 58 by bolts 68. The positive electrode coating unit 32 which is positioned below the electrode 30 is supported on the I-beams 24 and fixed to the frame members 50 by means of a plate 70 which is fastened on the one hand to the housing 72 of the unit 32 by a bolt 74 and on the other hand to the frame members 50 by bolts 76.

The printing heads 38 which comprise a plurality of negative electrodes 78 are each formed with a shaft 80 and mounted between a pair of opposite support blocks 82 (only one shown) through which the shaft extends. The support blocks 82 of the upper printing head 38 are each fixed by bolts 84 to an attachment bracket 86 which in turn is fastened to the frame member 48 by bolts 88. The negative electrode cleaning unit 46 is fixed to a support arm 90 secured to the support block 82. Similarly, the support blocks 82 of the lower printing head 38 are each fixed by bolts 84' to an attachment bracket 86' which in turn is fastened to the frame member 48 by bolts 88'; in this case, the negative electrode cleaning unit 46 is fixed by means of a bracket 92 to an angularly inclined support arm 90' which is clamped between the support block 82 and the attachment bracket 86'. Shims (not shown) can be arranged between the support blocks 82 and the attachment brackets 86,86' to adjust the electrode gap defined between the positive electrode 30 and the negative electrodes 78 of each printing head 38.

Two elongated colloid injectors 36 are provided for injecting a colloidal dispersion containing a coloring agent into the electrode gaps, each injector being associated with a respective printing head 38. The colloid injector associated with the upper printing head is fixed to the attachment brackets 86 whereas the colloid injector associated with the lower printing head is fixed to the frame members 48.

After electrocoagulation of the colloid, any remaining non-coagulated colloid is removed from the positive electrode surface 34 so as to fully uncover the dots of colored, coagulated colloid adhered on the surface 34. To this end, a device 40 is provided which comprises an elongated arm 94 to which is attached a soft rubber squeegee 96, the arm 94 and squeegee 96 having a length about twice the length of the electrode 30. The arm 94 is mounted on a rotating endless worm screw 98 which imparts to the arm 94 a reciprocating movement in a direction parallel to the longitudinal axis 64 of the electrode 30 so as to direct the non-coagulated colloid towards the extremities of the electrode 30 to trickle down the end surfaces 100. Two elongated rubber squeegees 102 and 102' are arranged at each extremity of the electrode 30 and of the printing heads 38, respectively, for channeling the non-coagulated colloid and excess colloidal dispersion into a trough 104 so as to be recirculated back to the injectors 36.

The pressure roller 42 which serves to bring the web 22 into contact with the dots of colored, coagulated colloid has a shaft 106 extending at each end thereof through a mounting block 108 held in slidable contact engagement with the frame members 48 and 50 on one side thereof, by means of two brackets 110 which are fastened to the block 108 by bolts 112 and abut the frame members 48 and 50 on the other side. Two pressure screws 114 (only one shown) each extending through the top frame member 54 and into a cavity 118 formed in the block 108 are provided for pressing the roller 42 against the positive electrode to form a nip 120 through which the web 22 is passed. A pressure of about 25 to about 100 kg/cm$^2$ can be applied with such an arrangement. In order to properly transfer the dots of colored, coagulated colloid onto the web 22, a positive drive is transmitted to the shaft 106 of the pressure roller 42 such that the electrode 30 and pressure roller 42 rotate in register.

After transfer of the dots of colored, coagulated colloid, any remaining coagulated colloid is removed from the surface 34 of the positive electrode 30 by means of the cleaning unit 44. Such a cleaning unit is fixed to the frame members 50 by means of a pair of L-shaped brackets 122 (only one shown) which are each fastened on the one hand to the housing 124 of the unit 44 by bolts 126 and on the other hand to the frame member 50 by a bolt 128, each bracket 122 being provided with guide pins 130 extending through the frame member 50. A plurality of rotating brushes 132 are arranged inside the cleaning unit 44 for cleaning the surface 34 of the electrode 30 prior to passing by the positive electrode coating unit 32 once again.

Figure 3:
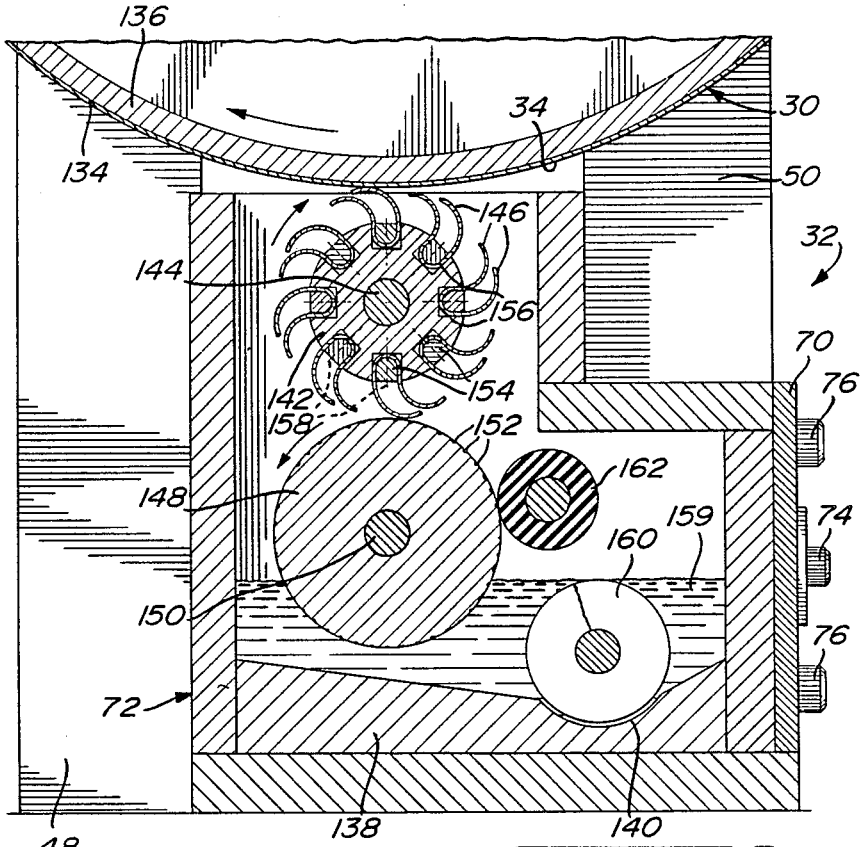
FIG. 3 is a sectional view of the positive electrode coating unit used for coating the positive electrode with an olefinic substance and a metal oxide.
Figure 4:
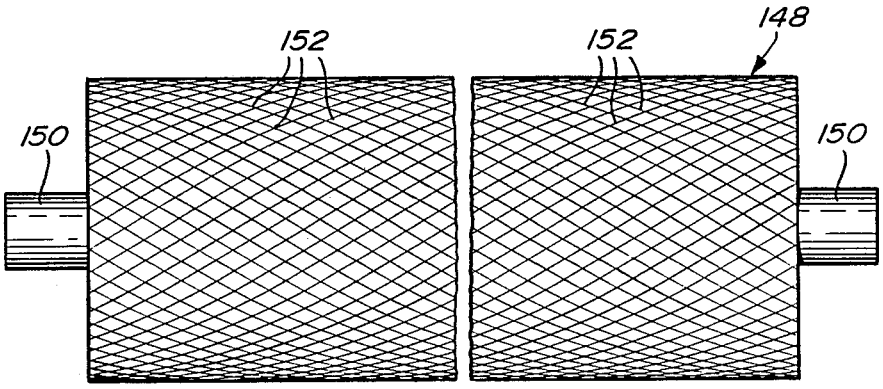
FIG. 4 is a longitudinal view of the distribution roller illustrated in FIG. 3.
Figure 6:
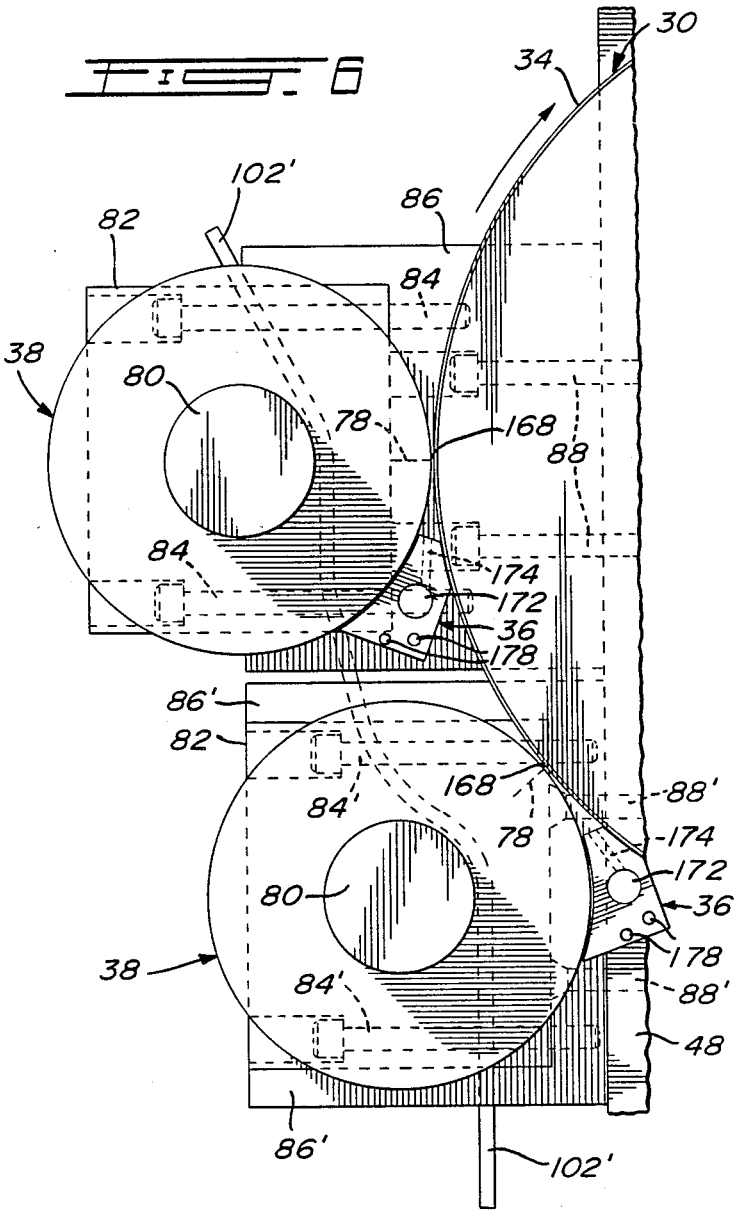
FIG. 6 is a fragmentary side view illustrating the printing heads used for the colloid electro-coagulation.

Turning to FIGS. 3 and 4, the positive electrode 30 is seen to comprise a pliable sheet 134 of electrolytically inert metal having a passive surface layer, such as stainless steel, and being wrapped around a tubular support 136 of cylindrical configuration. The positive electrode coating unit 32 which serves to coat the surface 34 of the positive electrode 30 with an olefinic substance and a metal oxide comprises a housing 72 which is opened at the top and has a generally V-shaped bottom wall 138 formed with a concave recess 140. Arranged inside the housing 72 are a roller 142 having a shaft 144 and a plurality of radially extending strips 146 of chamois leather adapted to contact the surface 34 of the electrode 30, and a distribution roller 148 having a shaft 150 and formed with a plurality of diagonally extending grooves 152 intersecting one another. The roller 148 is arranged in spaced-apart parallel relation to the roller 142 such as to contact the strips 146 thereof. The strips 146 of chamois leather are fixed to the roller 142 by means of a plurality of rods 154 which extend into recesses 156 formed in the roller 142 and which are fastened to the latter by screws 158 so as to retain the strips 146 in clamping engagement. The distribution roller 148 is partially immersed in a bath 159 containing the olefinic substance and the metal oxide in the form of a dispersion for filling the grooves 152 with the dispersion, the bath 159 being maintained under agitation by means of a rotating endless worm screw 160. An idler roller 162 of rubber material in rotating contact with the distribution roller 148 is provided for removing excess dispersion from the roller 148. The shafts 144 and 150 of the rollers 142 and 148 are driven independently of one another by separate motors (not shown). The roller 142 is rotated in the same direction of rotation as the electrode 30 whereas the roller 148 is rotated in a direction opposite to the direction of rotation of the roller 142. As the distribution roller 148 rotates in the dispersion, the grooves 152 thereon are filled with the dispersion which is thus transferred to the strips 146 to coat same. Rotation of the roller 142, on the other hand, causes the coated strips 146 to impinge upon the surface 34 of the positive electrode such as to transfer thereon the dispersion and thereby form the desired micro-droplets of olefinic substance containing the metal oxide. The amount of dispersion which is applied onto the strips 146 and hence onto the surface 34 is governed by the depth of the grooves 152 on the distribution roller 148 as well as by the speed of rotation of the roller 148.

The positive electrode coating unit 32' illustrated in FIG. 5 is similar to the unit shown in FIG. 3, except that use is made of a rotating brush 164 instead of a roller 142 with strips 146 to coat the surface 34 of the positive electrode 30 with the dispersion containing the olefinic substance and metal oxide. The brush 164 is provided with a plurality of radially extending bristles 168 made of horsehair and having extremities contacting the surface 34 of the electrode 30. The distribution roller 148 is arranged relative to the brush 164 such as to contact the bristles 166 at their extremities. As the roller 148 rotates in the dispersion, the grooves 152 thereon are filled with the dispersion which is thus transferred to the bristles 166 to coat the extremities thereof. Rotation of the brush 164, on the other hand, causes the coated bristles 166 to transfer the dispersion onto the surface 34 of the electrode 30 and thereby form the desired micro-droplets of olefinic substance containing the metal oxide.

As shown in FIGS. 6–9, the colloid injector 36 which serves to inject the colloidal dispersion into the electrode gap 168 formed between the positive electrode 30 and the negative electrodes 78 of each printing head 38 comprises an elongated body 170 formed with a feed channel 172 and a plurality of spaced-apart parallel conduits 174 in fluid flow communication with the feed channel 172. The conduits 174 define a plurality of fluid discharge orifices 178 arranged in spaced-apart relation along the length of the body 170 and along a line parallel to the longitudinal axis of the positive electrode 30, for discharging the colloidal dispersion in the form of jets in a direction substantially tangent to the surface 34 of the electrode 30. The body 170 of the injector 36 is also formed with a pair of threaded bores 178 for fixing the injector at each end thereof to the attachment bracket 86 or to the frame member 48 by means of bolts (not shown).

Figures 10, 11:
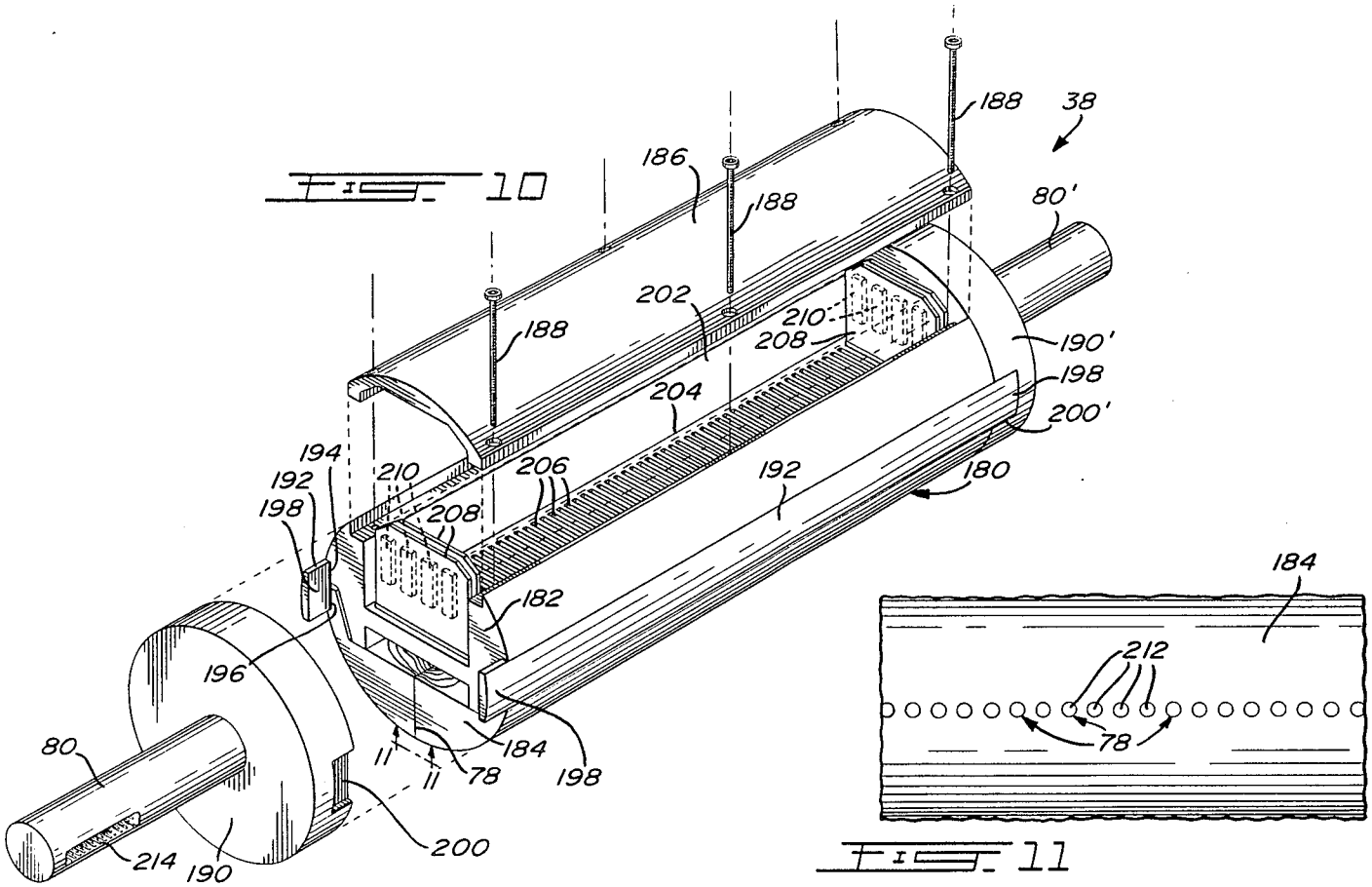
FIG. 10 is an exploded perspective view of one of the printing heads illustrated in FIG. 6.
FIG. 11 is sectional view taken along line 11—11 of FIG. 10.

Turning to FIGS. 10–12, the printing head 38 is seen to comprise a main body 180 formed of two sections 182 and 184, a cover 186 and a plurality of screws 188 for fixing the cover 186 to the section 182 as well as for securing the sections 182 and 184 to one another. Two end-caps 190 and 190' formed with outwardly extending cylindrical projections 80 and 80' are provided for closing the ends of the body 180, the projections 80 and 80' extending along a common central longitudinal axis so as to define a shaft. Two elongated side bars 192 extending into recesses 194 and 196 formed in the sections 182 and 184 of the body 180 are adhered to the body 180 by means of a silicone-based adhesive to provide a waterproof seal. The side bars 192 project from the of opposite tongues 198 extending into corresponding recesses 200 and 200' formed in the end-caps 190 and 190', respectively; such an arrangement prevents the end-caps 190,190' from rotating relative to the body 180. The entire assembly is mounted between the support blocks 82 with the shaft 80,80' extending therethrough.

As shown in FIG. 10, the section 182 of the body 180 is formed with an elongated cavity 202 at the bottom of which is arranged a multi-socket plate 204 integrally formed with the body section 182 and provided with a plurality of electrical sockets 206 for receiving a predetermined number of printed circuit boards 208 comprising integrated circuits 210. The body section 184, on the other hand, comprises a plurality of negative electrodes 78 electrically insulated from one another and arranged in rectilinear alignment along the length of the section 184 to define a series of corresponding negative electrode active surfaces 212, as best shown in FIG. 11. The electrodes 78 are in the form of small wires which are electrically connected to the printed circuit boards 208 via the sockets 206. The cylindrical projection 80 is provided with a multi-pin electrical socket 214 electrically connected to the multi-socket plate 204 by wires (not shown), for electrically connecting the printing head 38 to a central processing unit (not shown). The printing head 38 is mounted relative to the positive electrode 30 such that the surfaces 212 of the negative electrodes 78 are disposed in a plane parallel to the longitudinal axis 64 of the electrode 30 and are spaced from the positive electrode active surface 34 by a constant predetermined gap 168 (see FIGS. 2 and 6). The electrodes 78 are also spaced from one another by a distance at least equal to the electrode gap 168 to prevent edge corrosion of the negative electrodes.

As a typical example, the printing head 38 may comprise 2112 negative electrodes 78 defining 22 channels each having 96 electrodes, there being three printed circuit boards 208 associated with each channel and each printed circuit board being electrically connected to 32 electrodes. The electronic circuitry of the boards 208 is operative to sequentially scan the electrodes of each channel while performing such a scanning simultaneously for all channels, and to apply a pulse-modulated signal to selected ones of the electrodes 78 during scanning to energize same. The pulse-modulated signal may have a pulse duration ranging from about 250 nanoseconds to about 4 microseconds. An electrical signal with a pulse duration of 250 nanoseconds provides a dot of electro-coagulated colloid having an optical density of 0.02 (very light grey), whereas an electrical signal with a pulse duration of 4 microseconds provides a dot of electrocoagulated colloid having an optical density of 1.20 (black). It is also possible to vary the pulse duration by a predetermined number of time increments, for example, 63 increments of 60 nanoseconds each or 255 increments of 15 nanoseconds each, depending upon the level of fidelity of reproduction required. A signal whose pulse duration can be varied from 250 nanoseconds to 4 microseconds in 255 increments delivers of course the best photographic reproduction possible. Thus, in this case, the printing of a dot starts with a pulse duration of 250 nanoseconds, progresses with 255 increments of 15 nanoseconds up to 4.075 microseconds and stops when the desired optical density is reached.

As shown in FIGS. 2 and 12, the printing heads 38 are rotatable about their longitudinal axis for moving the negative electrodes 78 between an operative position (shown in FIG. 2) whereat the surfaces 212 of the electrodes 78 are spaced from the surface 34 of the positive electrode 30 by the gap 168 and a cleaning position (shown in FIG. 12) whereat the surfaces 212 of the negative electrodes are exposed to permit cleaning thereof. The shaft 80,80' of each printing head 38 can be connected to a step-motor (not shown) for rotating the head 38 and thus moving the negative electrodes 78 between the operative and cleaning positions. As best shown in FIG. 12, the negative electrode cleaning unit 46 comprises a rotatable brush 216 arranged in a housing 218 fixed to the support arm 90. The brush 216 is rotated by means of a motor 220 having a pulley 222 which is connected by a belt 224 to a pulley 226 mounted on the shaft 228 of the brush 216. The motor 220 is fixed to the housing 218 by means of an L-shaped bracket 230. A soft rubber squeegee 232 is also provided for wiping the surfaces 212 of the negative electrodes 78 when these are moved back to their operative position.

Figure 13:
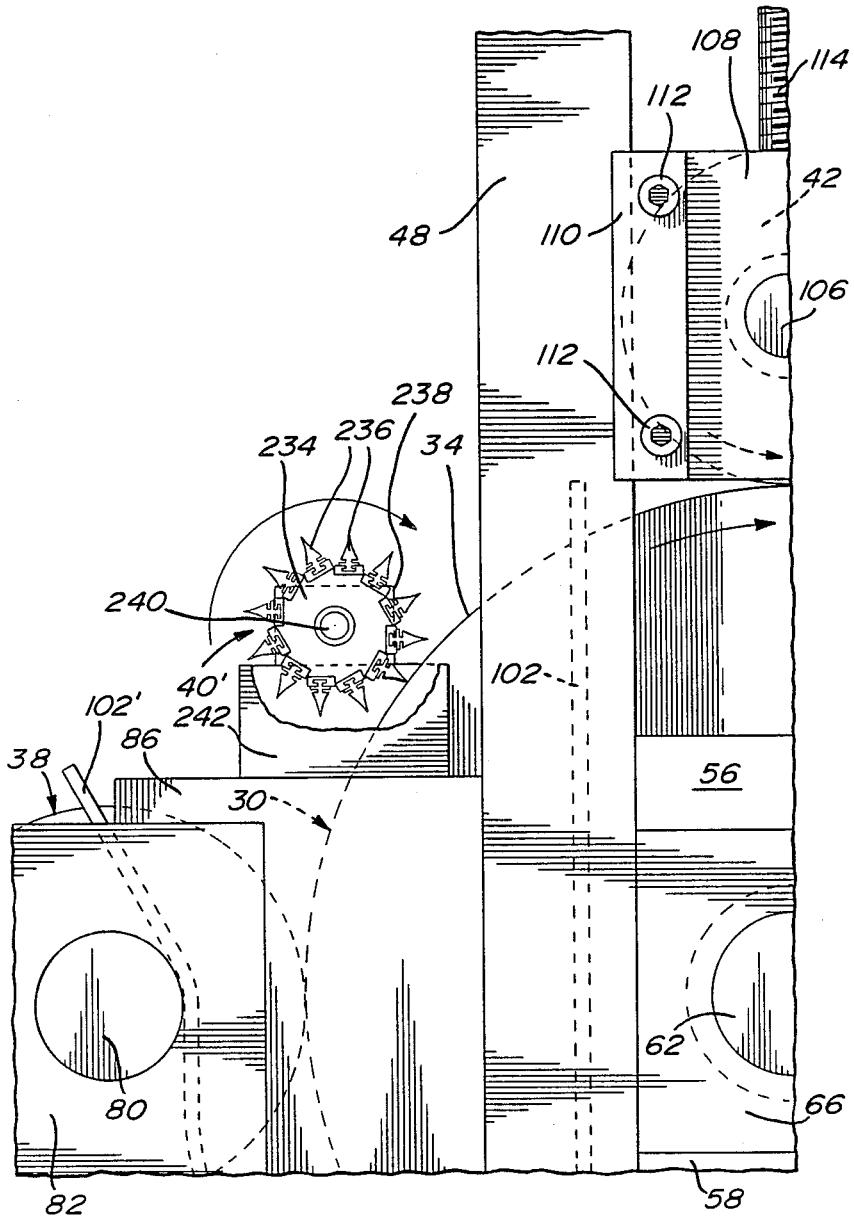
FIG. 13 is a fragmentary side view illustrating a different device for removing the non-coagulated colloid from the surface of the positive electrode.

Instead of using the device 40 illustrated in FIG. 2 for removing any remaining non-coagulated colloid from the surface 34 of the positive electrode 30, it is also possible to use a multi-blade device 40' as shown in FIG. 13. As shown, the device 40' comprises a roller 234 provided with a plurality of radially extending squeegees 236 arranged around the roller. The roller 234 is mounted between a pair of opposite support brackets 238 (only one shown) through which the shaft 240 of the roller extends, the brackets 238 being fixed to a container 242 containing a cleaning solution and holding the roller 234 such as to permit the squeegees 236 to be immersed in the cleaning solution. The shaft 240 of the roller 234 is connected to a step-motor (not shown) for intermittently rotating the roller to move a squeegee 236 from an operative position whereat the squeegee contacts the surface 34 of the electrode 30 and a cleaning position whereat the squeegee is immersed in the cleaning solution.

Figure 14:
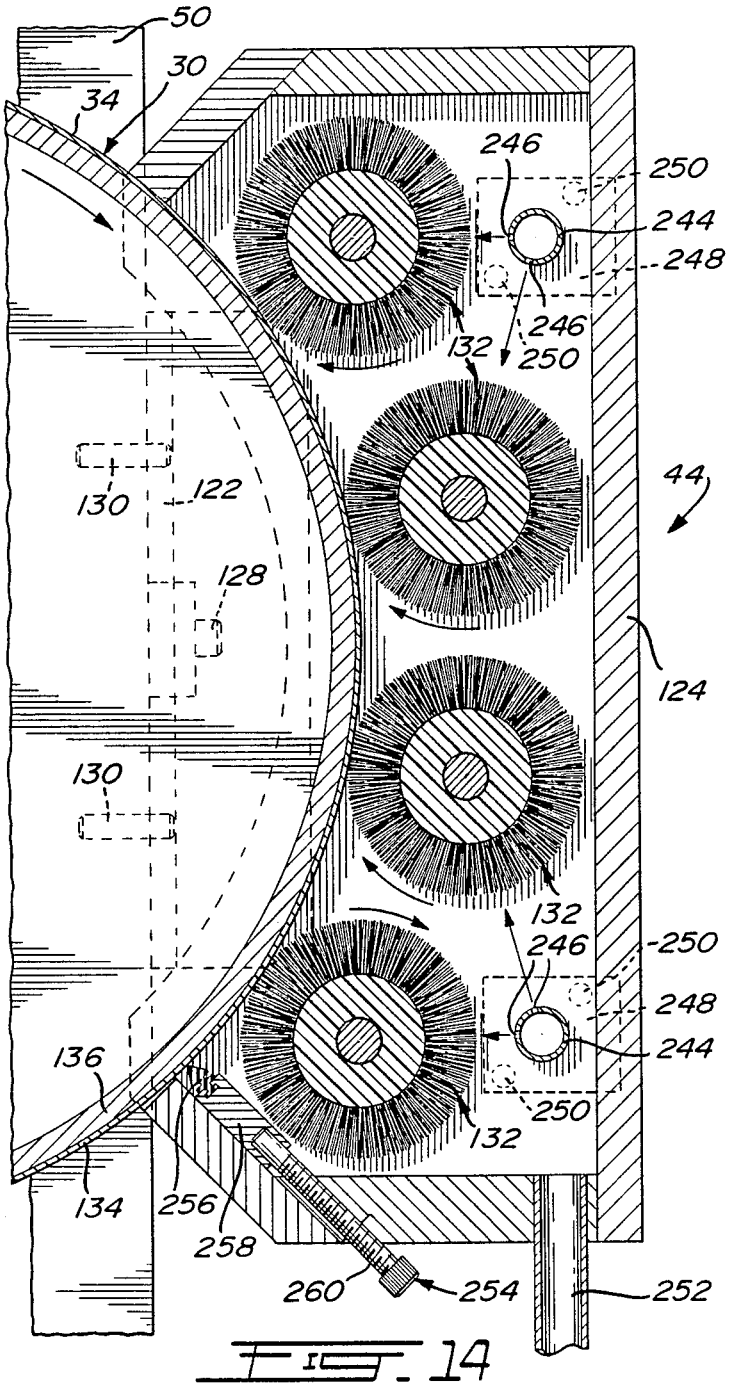
FIG. 14 is a sectional view illustrating the positive electrode cleaning unit used for removing any remaining coagulated colloid from the positive electrode active surface.

FIG. 14 illustrates the positive electrode cleaning unit 44. As shown, such a cleaning unit comprises a plurality of rotating brushes 132 in contact with the surface 34 of the positive electrode 30 for cleaning same. Any residual coagulated colloid adhered to the surface 34 and removed by the brushes 132 is washed away by means of two tubular shower elements 244 provided with a plurality of spaced-apart holes 246 arranged along the length thereof for spraying a cleaning liquid onto the brushes 132. The shower elements 244 are fixed to the housing 124 of the cleaning unit 44 by attachment brackets 248 which are fastened to the housing 124 with bolts 250. The cleaning liquid with entrained colloid residues is allowed to flow into a drain pipe 252 so as to be collected and recirculated back to the shower elements 244 after removal of the colloid residues. Watertightness is ensured by means of a device 254 comprising a squeegee 256 fixed to an attachment member 258 and a threaded member 260 extending into the attachment member 258, the threaded member 260 being threadably engaged with the bottom wall of the housing 124 to adjustably move the attachment member 258 and press the squeegee 256 against the surface 34 of the positive electrode 30 with the desired pressure.

Referring now to FIGS. 15 to 21, there is shown another embodiment of the present invention. In this embodiment, the web 322, on which the images are to be transferred, passes in a vertical plane about a roller 342 which rotates about a vertical axis coincident with the shaft 316. The roller 342 is in the form of a cylindrical drum having a peripheral rubber-coated surface 343.

Figure 16:
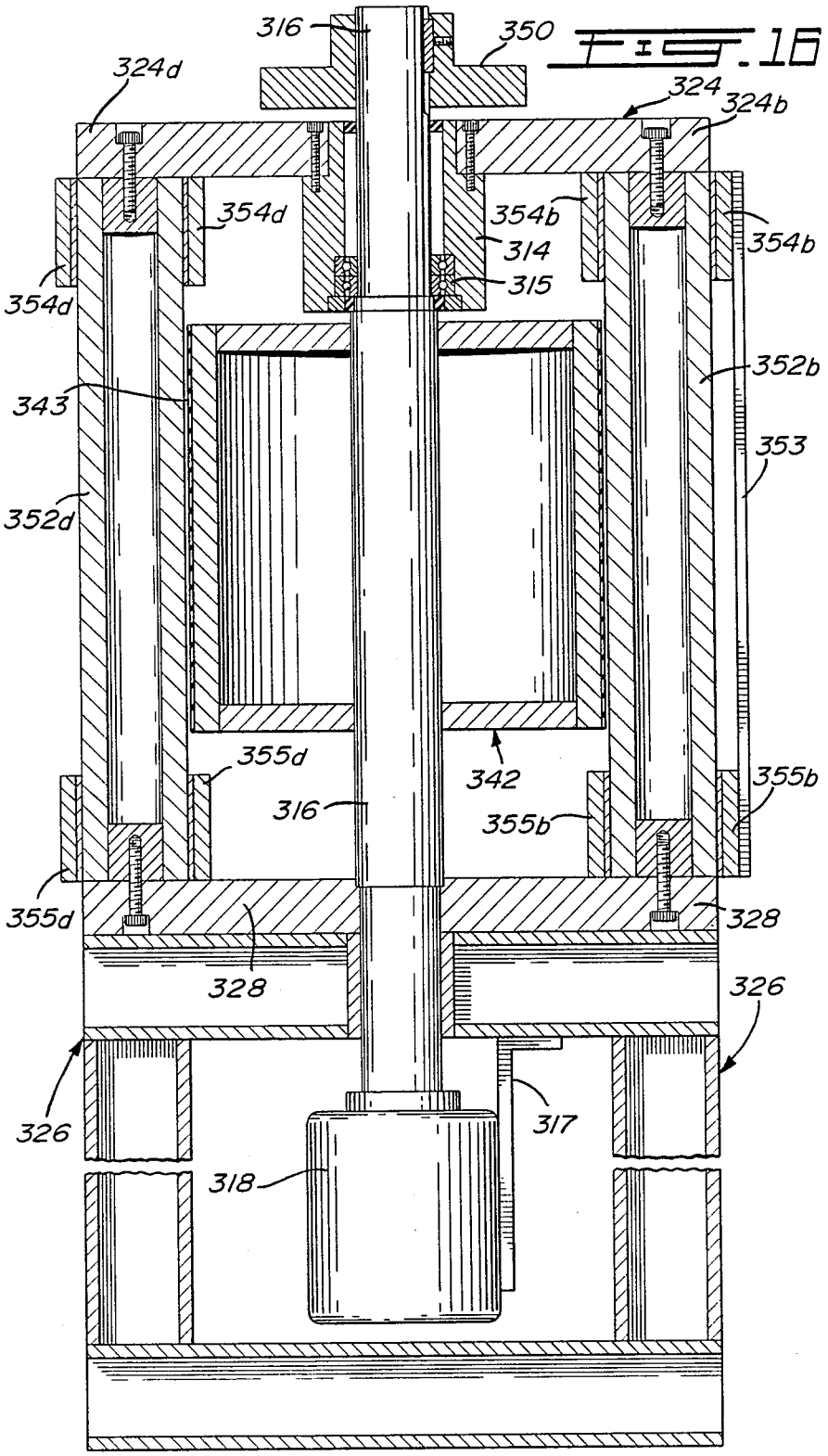
FIG. 16 is a sectional view taken along line 16—16 of FIG. 15.

The shaft 316 is driven by a motor 318, shown in FIG. 16, mounted by means of bracket 317 to base frame 326. The shaft 316 is mounted in bearings 315 within a cylindrical collar 314.

Figure 15:
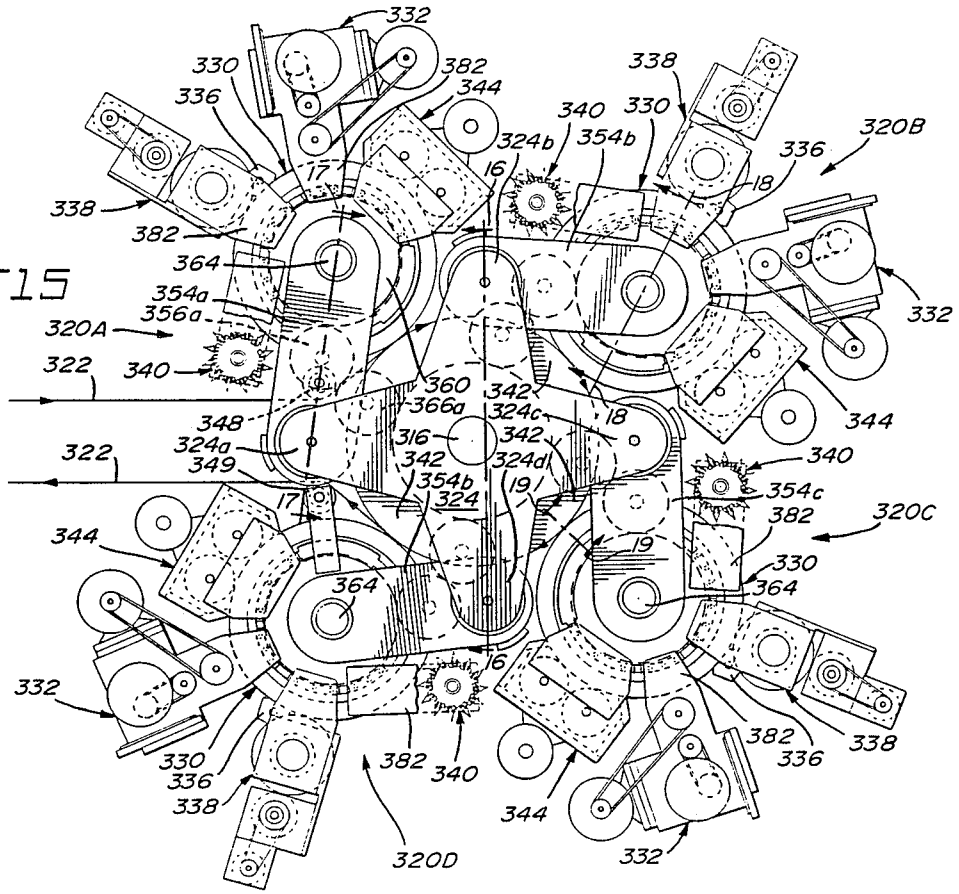
FIG. 15 is a top plane view illustrating an electrocoagulation printing apparatus according to another preferred embodiment of the invention.

On the base frame 326 is a horizontal star-shaped base plate 328 to which are mounted pivot columns **352*a*, 352*b*, 352*c*, and 352*d*. On top of the pivot columns 352 is mounted a star-shaped top plate 324. The collar 314 is mounted to the plate 324 about a shaft opening. A sun gear 350 is keyed to the top end of the shaft 316. As shown in FIG. 15, the top plate 324 has four projecting arms 324*a*, 324*b*, 224*c*, and 324*d* corresponding to the pivot columns 352*a*, 352*b*, 352*c* and 352*d*. The base plate 328 is identical to the top plate 324**.

Stations 320A, 320B, 320C and 320D are mounted, as will be described, to the respective pivot columns **352*a*, 352*b*, 352*c* and 352*d*. The four stations 320A, 320B, 320C and 320D are identical, and each compares to the printing towers 20A, 20B, 20C and 20D respectively, shown in FIG. 1. As in the embodiment shown in FIG. 1, each printing station will transfer a different color of the image onto the web 322 which passes about the cylindrical roller 342. As shown in FIG. 15, the web 322 is also restrained by means of guide rolls 348 and 349 which are positioned to guide the entry of the web 322 onto the cylindrical roller 342 and the exiting thereof. The guide rolls 348 and 349 can also be seen in FIG. 17**.

Since each of the printing stations 320A, 320B, 320C and 320D are identical, only one station will be described. The reference numbers referred to are identical in each station. From FIGS. 17 and 18, sections have taken through stations 320A and 320B, respectively.

A pair of arms **354*a* and 355*a* pivotally mounted to column 352*b* extends outwardly therefrom to subtend a shaft 364 by means of bearings 365 mounting the cylindrical positive electrode 330. Although FIG. 17 only shows one of the arms 354*a*, it is understood that an identical arm 355*a* would extend from the bottom of the column 352*a* and would be journalled on the column 352*a* as shown in FIG. 16 with reference to the arm 355*d* on the pivot column 352*d*. On the top of the shaft 364, there is provided a keyed gear 360*a* meshing with gear 356*a***.

Figure 20:
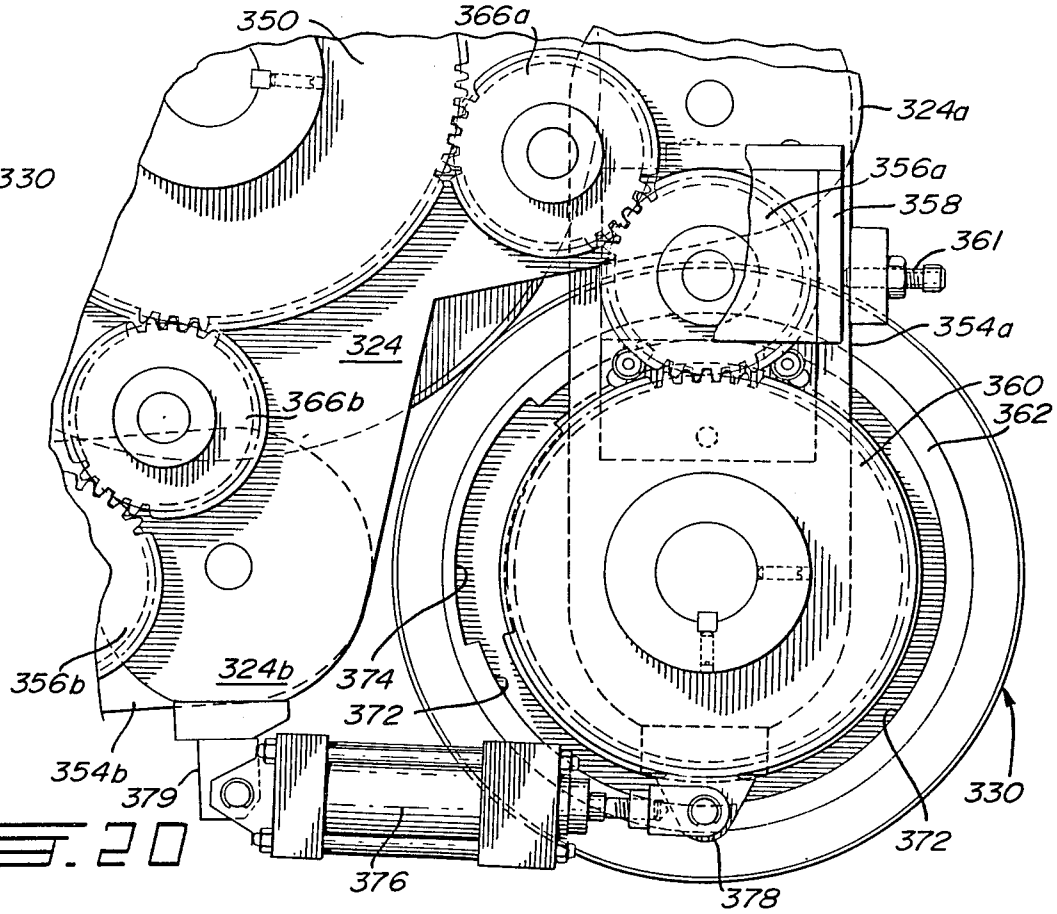
FIG. 20 is a fragmentary top view showing how each positive electrode is coupled to the central roller illustrated in FIG. 15 and how it is urged thereagainst.

However, the drive of shaft 364 iq best seen in FIG. 20. In this illustration, gear **356*a* is shown as meshing with an idler gear 366*a* which, in turn, meshes with sun gear 350 fixed to the top of shaft 316. Thus, the drive from motor 318 which rotates the roller 342 in a clockwise manner transmits a counterclockwise rotation to each of the positive electrode rolls 330 in the respective stations 320A to 320D, through gear trains 350, 366, 356, and gear 360. Each station, of course, has individual sets of gear trains 366, 356, and 360 which engage a different quadrant of sun gear 350**.

Figure 17:
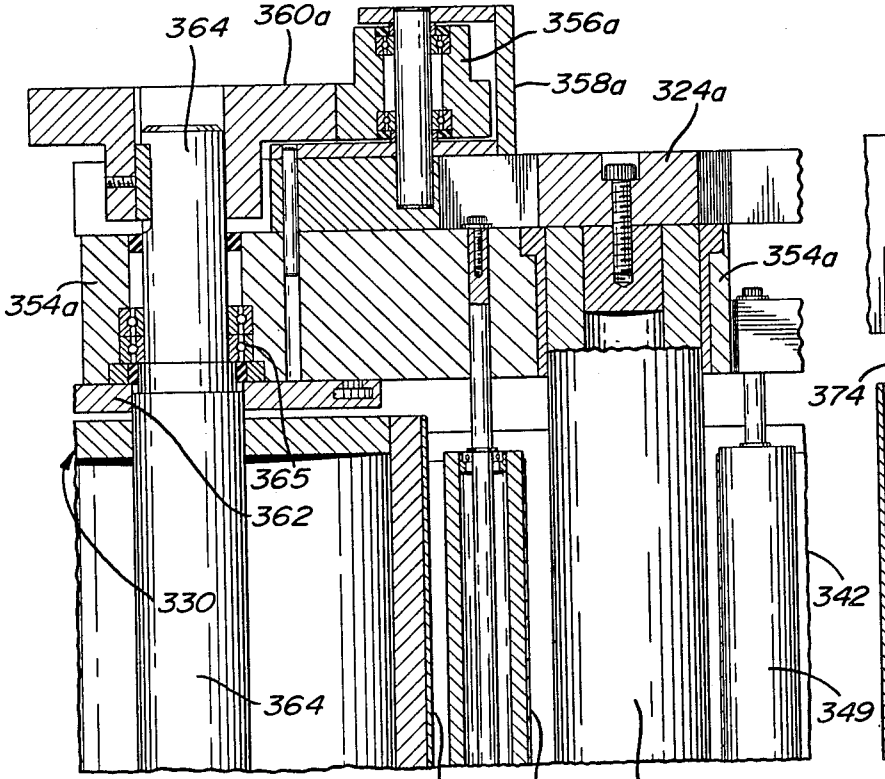
FIG. 17 is a sectional view taken along line 17—17 of FIG. 15.

FIG. 17 shows a box 358 which slides independently of the arm 354*a* mounting gear 365*a*. The adjustment screw 361, shown in FIG. 20, is effective for adjusting the box 358 mounting the gear 356*a* relative to the arm 354*a*.

As shown in FIG. 16, respective pairs of arms 354 and 355 are connected by a plate 353 which ensures coincident movement of the respective arms 354 and 355. A hydraulic cylinder and piston 376 controls the pivoting movement of the arms 354 and 355 about the pivot columns 352. As shown in FIG. 20, the piston and cylinder arrangement 376 is mounted at one end to a bracket 379 on the top plate extension 324*b*, for instance, and at the other end to the extremities of the top arm 354*a*. The 10 pivoting movement required is slight in that, as will be described later, the positive electrode roll 330 must be brought into a pressure contact at a nip with the roller 342 through which the web 322 passes.

Figure 18:
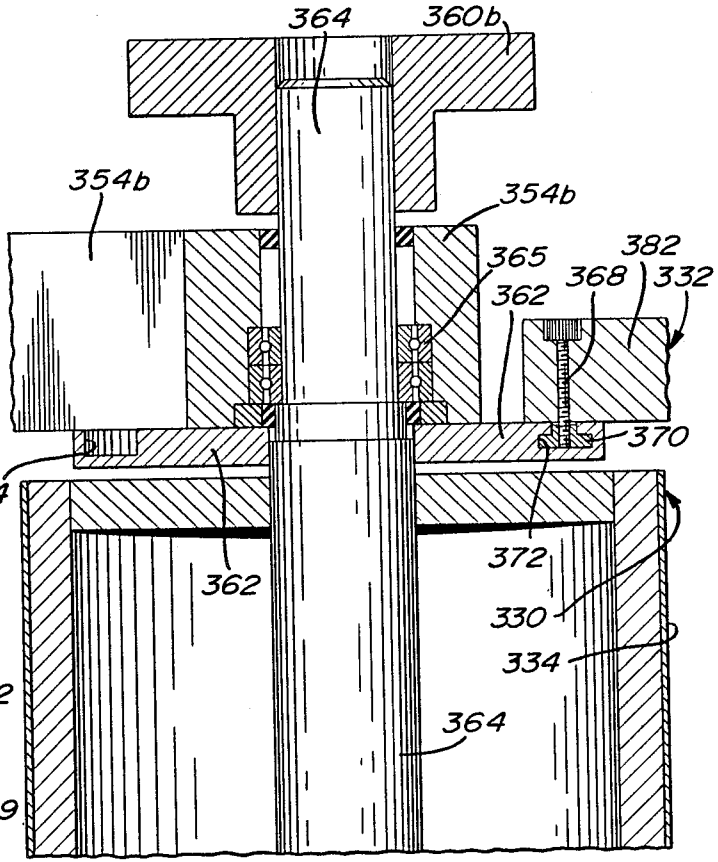
FIG. 18 is a sectional view taken along line 18—18 of FIG. 15.

Referring to FIGS. 17 and 18, a mounting disc 362 is fixedly mounted to the arm 354*a* and the disc 362 includes a rotary slot 372 with an enlargement at 374 as shown in FIG. 20. Each of the accessory units in a station 320 are mounted by means of this slot 372 as will be described later. A similar disc 362 would also be provided at the bottom of the station 320 fixed to the arm 355.

In the embodiment shown in FIGS. 15 through 21, the positive electrode roll 330 which rotates counterclockwise about a vertical axis coincident with shaft 364 is equivalent to the positive electrode 30 described in FIGS. 1 through 14. The cylindrical roller 342 which is common to the four stations 320A, 320B, 320C and 320D, replaces the individual pressure rollers 42 in the stations 20A, 20B, 20C and 20D of FIG. 1. In other words, the four printing stations of the present embodiment are mounted about a single common pressure roller 342. All of the axes of rotation of the various elements in the embodiment shown in FIGS. 15 through 21 are vertical.

Figure 21:
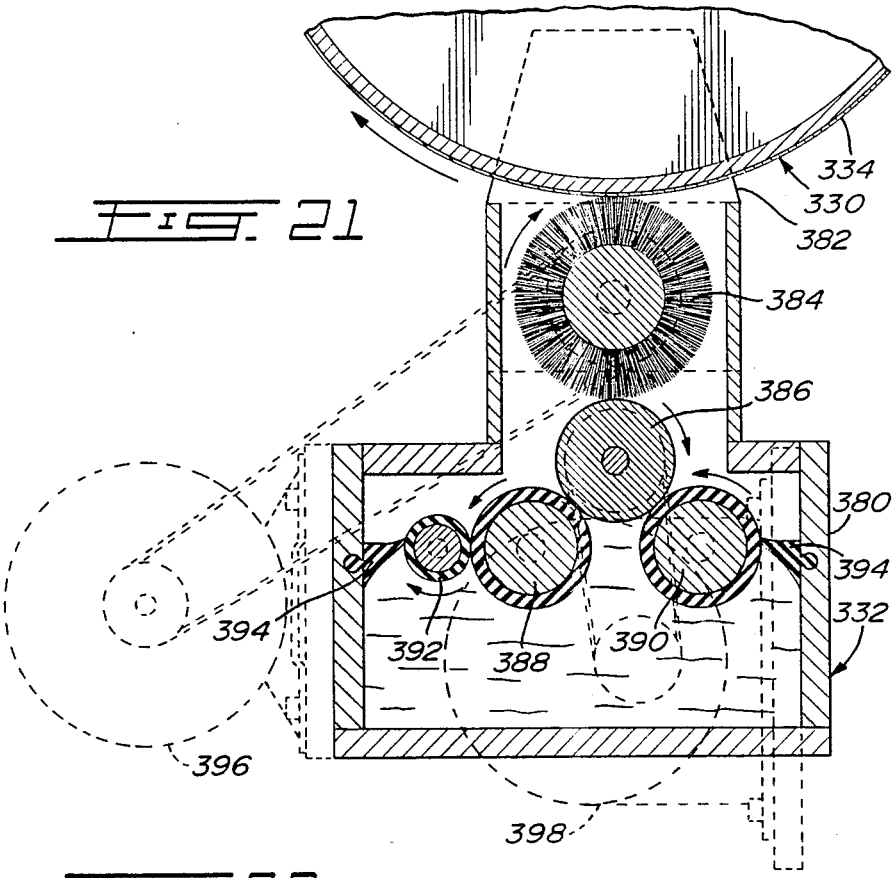
FIG. 21 is a sectional view of the positive electrode coating unit used for coating the surface of the positive electrodes illustrated in FIG. 15.

As seen in FIG. 15, a first accessory unit is the positive electrode coating unit 332 which is illustrated in more detail in FIG. 21. The positive electrode coating unit 332 is the equivalent of the coating unit 32' shown in FIG. 5. However, since the unit 332 extends in a vertical axis parallel to the axis of rotation of the positive electrode roll 330, the coating dispersion must be dealt with differently. In the housing 380 forming the container for the dispersion of olefinic substance containing a metal oxide, a distribution roller 386 and three idler roller 388, 390 and 392 are arranged to enable the transfer of the dispersion to the brush 384 and also to seal the dispersion in a reservoir which extends vertically. In addition, seal members or squeegees 394 are provided in the housing walls at opposite ends thereof in contact with the rollers 390 and 392 to form a vertical barrier wall to prevent the coating dispersion from immersing the brush 384.

As is shown in FIG. 21, the brush 384 is driven independently by motor 396, while the distribution roller 386 which is similar to the roller 148 illustrated in FIG. 4 is driven by motor 398 shown in dotted lines. The rotation of roller 386 will also entrain the idler rollers 388, 390 and 392. As with the embodiment shown in FIG. 5, the roller 386 will be effective to transfer a predetermined amount of dispersion to the tips of the bristles on the roller 384 to properly transfer same in the form of micro-droplets to the surface 334 of the positive electrode roll 330.

The coating unit 332 is mounted to the mounting discs 362 as referred to earlier. Each of the units has a top and bottom mounting plate 382 mounted to its housing which in turn is connected to the plate 362 by means of bolts 368 threadedly mated to T-shaped flange nuts 370 engaged in the slot 372. The widened portion 374 shown in FIG. 20 is arranged to receive the nuts 370 which are then moved in the slot 372 to a desired location to receive the mounting bolts 368 provided in the flanges 2. Of course, a flange 382 is provided at the bottom of each unit, although not shown in FIGS. 17 and 18, and would be mounted to the companion mounting disc 362. Each of the units which will be described now are mounted in a similar fashion about the periphery of the positive electrode roll 330.

Downstream, counterclockwise of the coating unit 332 is the printing head 338. The printing head 338 and the negative electrode cleaning unit 346 are identical in construction to the printing head 38 and negative electrode cleaning unit 46 described with reference to the embodiment shown in FIGS. 1 to 14 and the description thereof will not be repeated here. Suffice it to say that the housing mounting the printing head 338 in a vertical direction is mounted to the mounting discs 362 by means of flanges 382 as previously described with respect to the coating unit 332.

Figure 7:
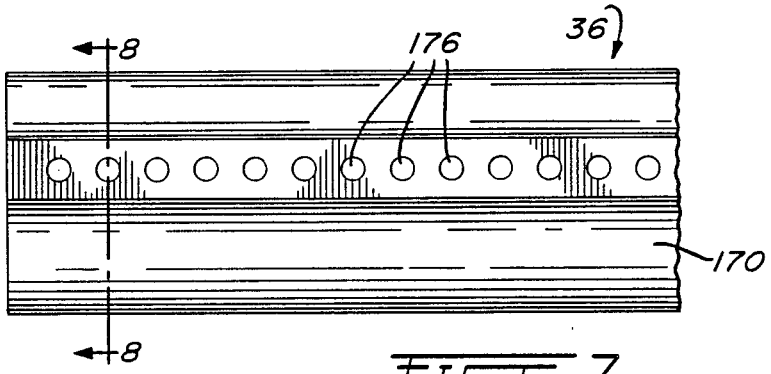
FIG. 7 is a fragmentary longitudinal view of the colloid injector.
Figure 8:
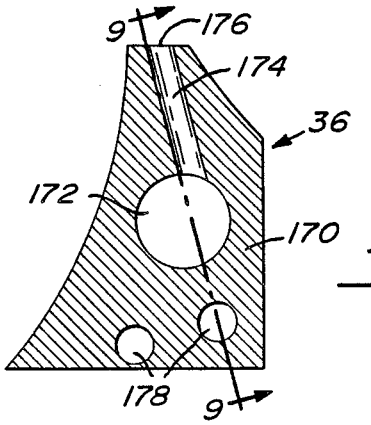
FIG. 8 is a sectional view taken along line 8—8 of FIG. 7.
Figure 9:
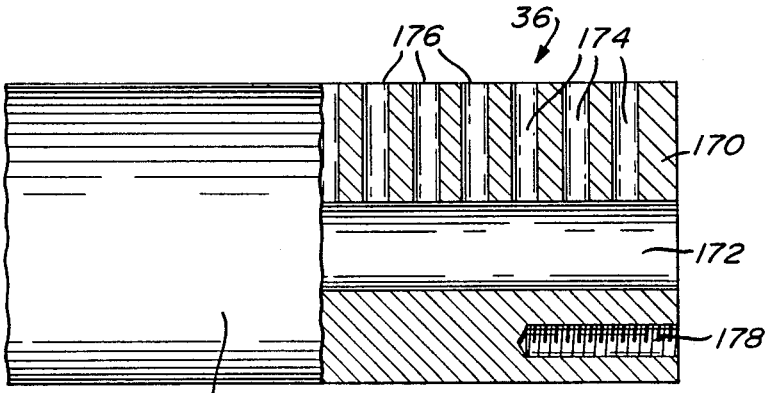
FIG. 9 is a sectional view taken along line 9—9 of FIG. 8.

Colloid injectors 336 are also mounted to the housings of the printing head 338, and these colloid injectors are identical to the injectors 36 shown in FIG. 7.

A squeegee roller 340 is provided downstream of the printing head 338 and is similar to the multi-blade device 40' shown in FIG. 13. This unit will not be described further since its function and construction is similar to that provided earlier in the specification in relation to FIG. 13. It also is independently mounted to the mounting discs 362 by means of flanges 382.

Figure 19:
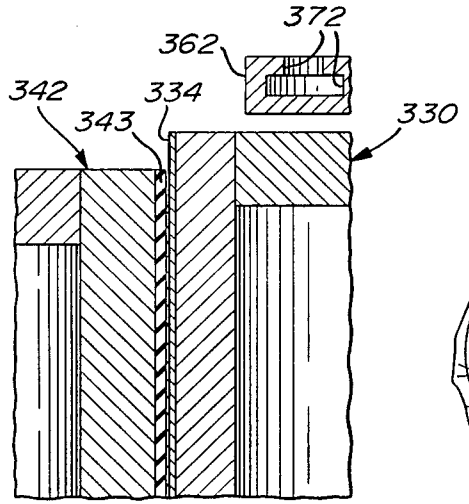
FIG. 19 is a sectional view taken along line 19—19 of FIG. 15.

As previously described, the positive electrode roll 330 comes into contact with the roller 342 to form a nip at which the dots of colored, coagulated colloid are transferred to the web, and this nip is illustrated in FIG. 19.

Preferably, the roller 342 is covered by a peripheral rubber coating 343 while the positive electrode has a surface 334 similar to surface 34 described in relation to the embodiment of FIGS. 1 to 14.

A cleaning unit 344 downstream of the nip is mounted to the mounting discs 362 in a manner similar to that described with respect to unit 332 and is operative for cleaning the positive electrode in the same manner as cleaning unit 44 is in relation to the embodiment of FIGS. 1 to 14 and as more clearly described, for instance, in FIG. 14.

Thus, the web 322 enters the apparatus from the left-hand side in the top view of FIG. 15, in a vertical plane and passes through nips formed between the positive electrodes 330 of each of the stations 320A, 320B, 320C and 320D successively, and the printing and transferring process at each of the stations and at the nips formed with the roll 342 is the same as the printing and transferring between the positive electrode 30 and the pressure roller 42 in each respective printing tower 20A, 20B, 20C, and 20D of the embodiment of FIGS. 1 to 14.

Figure 22:
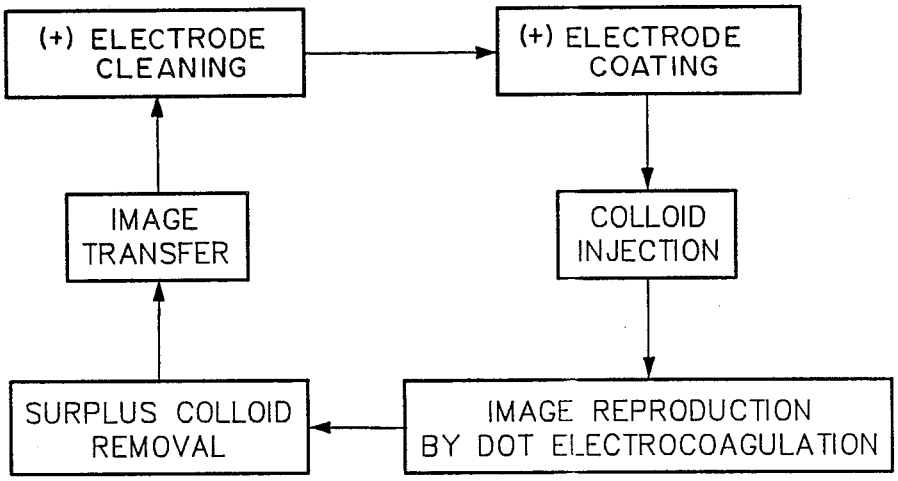
FIG. 22 is a schematic diagram showing each step of the electrocoagulation printing method of the invention.

FIG. 22 schematically illustrates the various steps of the electrocoagulation printing method according to the invention. As shown, each printing cycle whether performed by the printing towers 20 of the embodiment illustrated in FIGS. 1–14 or by the printing stations 320 of the embodiment illustrated in FIGS. 15–21 starts by the positive electrode to form on the surface thereof micro-droplets of olefinic substance containing a metal oxide. A colloidal dispersion containing an electrolytically coagulable colloid, a liquid dispersing medium, a soluble electrolyte and a coloring agent is then injected into the gap formed between the positive and negative electrodes and selected ones of the negative electrodes are electrically energized to cause point-by-point selective coagulation and adherence of the colloid onto the olefin and metal oxide coated surface of the positive electrode, thereby forming a series of dots of colored, coagulated colloid representative of a desired image. Any remaining non-coagulated colloid is removed from the surface of the positive electrode to fully uncover the dots of colored, coagulated colloid which are then contacted with a substrate to cause transfer of the colored, coagulated colloid onto the substrate and thereby imprint the substrate with the image. The surface of the positive electrode is thereafter cleaned to remove any residual coagulated colloid, prior to being coated once again with the olefinic substance and metal oxide.

Figure 23:
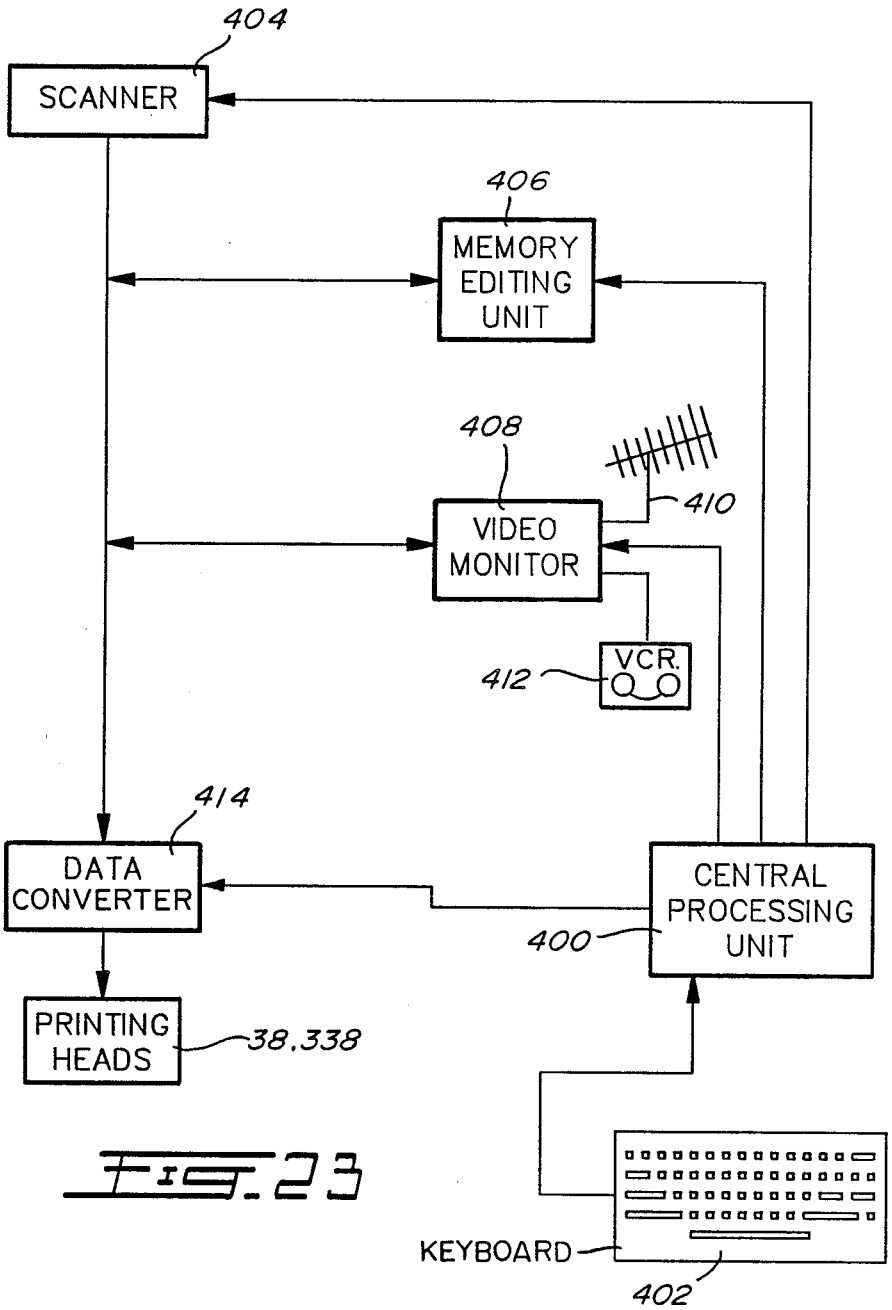
FIG. 23 is another schematic diagram showing how various signals of information may be treated before being transmitted to the printing heads.

FIG. 23 schematically illustrates how various signals of information may be treated before being transmitted to the printing heads 38 or 338 of the embodiments of FIGS. 1–14 and 15–21, respectively. A central processing unit 400 which is operated by a keyboard 402 is connected to a scanner 404 having four color channels and adapted to scan an image to be reproduced, to a memory editing unit 406 and to a video monitor 408. The scanner 404, memory editing unit 406 and video monitor 408 are all interconnected for enabling the signal from the scanner 404 to be corrected and/or modified. Instead of using a scanner 404, it is also possible to feed a signal coming from a T.V. receptor 410 or a video cassette recorder 412. The digital signals from the scanner 404, memory editing unit 406, T.V. receptor 410 or video cassette recorder 412 are fed to a data converter 414 so as to be converted into pulse-modulated signals which are then transmitted to the printing heads 38,338.

By proper electronic circuitry, it is possible with the electrocoagulation printing method and apparatus of the invention to print an image using the so-called Under Color Removal process for color printing. In such a process, instead of using a scanner with four color channels (black, cyan, magenta and yellow), a scanner comprising only three color channels (cyan, magenta and yellow) is used to scan an image to be reproduced and the common level of the three colors which when superimposed represent a black is removed to print a black dot, leaving only two remaining levels of color to be printed. For example, supposing that the scanner scanning an image provides data showing that the cyan dot should be printed with pulse duration of 1,800 microseconds, the magenta dot should be printed with a pulse duration of 2,400 microseconds and the yellow dot should be printed with a pulse duration of 3,200 microseconds, the electronic circuitry computes the common pulse duration which is 1,800 microseconds and issues a command signal to print a black dot with a pulse duration of 1,800 microseconds. To render the appropriate color of the scanned image, it will thus be necessary to print a magenta dot with a pulse duration of 600 microseconds and a yellow dot with a pulse duration of 1,400 microseconds. The superimposition of the three dots (one in black, one in magenta and one in yellow) will therefore render the appropriate color of the scanned image without printing any cyan dot. Such a printing method permits a dramatic saving of colored colloid.

We claim:

1. A method of reproducing an image and transferring same onto a substrate, which comprises the steps of:

(a) providing a positive cylindrical electrode having a central longitudinal axis and rotating at substantially constant speed about said longitudinal axis, said positive electrode being formed of an electrolytically inert metal and having a passivated surface defining a positive electrode active surface, and a plurality of negative electrolytically inert electrodes electrically insulated from one another and arranged in negative electrode active surfaces disposed in a plane parallel to the longitudinal axis of said positive electrode and spaced from the positive electrode active surface by a constant predetermined gap, said negative electrodes being spaced from one another by a distance at least equal to said electrode gap to prevent edge corrosion of said negative electrodes;

(b) coating the positive electrode active surface with an olefinic substance and a metal oxide to form on said surface micro-droplets of olefinic substance containing said metal oxide in an amount to prevent corrosion of said positive electrode;

(c) filling said electrode gap with a substantially liquid colloidal dispersion containing an electrolytically coagulable colloid, a liquid dispersing medium, a soluble electrolyte and a coloring agent, and having a substantially constant temperature;

(d) electrically energizing selected ones of said negative electrodes to cause point-by-point selective coagulation and adherence of the colloid onto the olefin and metal oxide-coated positive electrode active surface opposite the electrode active surfaces of said energized negative electrodes while said positive electrode is rotating, thereby forming a series of corresponding dots of colored, coagulated colloid representative of a desired image;

(e) removing any remaining non-coagulated colloid from said positive electrode active surface; and (f) contacting the dots of colored, coagulated colloid with a substrate at a transfer position to cause transfer of the colored, coagulated colloid onto said substrate and thereby imprint said substrate with said image.

2. A method as claimed in claim 1, wherein said electrolytically inert metal is selected from the group nickel, aluminum and tin.

3. A method as claimed in claim 1, wherein said positive electrode comprises a pliable sheet of electrolytically inert metal having a passive surface layer and extending on a tubular support member having a cylindrical surface, said metal sheet being held in tight contact engagement with the surface of said support member to conform therewith and thereby have a surface of cylindrical configuration defining said positive electrode active surface.

4. A method as claimed in claim 3, wherein said metal sheet is made of stainless steel.

5. A method as claimed in claim 1, wherein said electrode gap ranges from about 50 to about 100$\mu$.

6. A method as claimed in claim 5, wherein said electrode gap is of the order of 50μ.

7. A method as claimed in claim 1, wherein said negative electrodes are spaced from one another by a distance equal to said electrode gap.

8. A method as claimed in claim 1, wherein said negative electrodes are spaced from one another by a distance greater than said electrode gap.

9. A method as claimed in claim 6, wherein said negative electrodes are spaced from one another by a distance of about 75μ.

10. A method as claimed in claim 1, wherein said olefinic substance is selected from the group consisting of unsaturated fatty acids, unsaturated vegetable oils and waxes.

11. A method as claimed in claim 10, wherein said olefinic substance is an unsaturated fatty acid selected from the group consisting of arachidonic acid, linoleic acid, linolenic acid, oleic acid and palmitoleic acid.

12. A method as claimed in claim 10, wherein said olefinic substance is an unsaturated vegetable oil selected from the group consisting of corn oil, linseed oil, olive oil, peanut oil, soybean oil and sunflower oil.

13. A method as claimed in claim 1, wherein said metal oxide is selected from the group consisting of aluminum oxide, ceric oxide, chromium oxide, cupric oxide, magnesium oxide, manganese oxide, titanium dioxide and zinc oxide.

14. A method as claimed in claim 13, wherein said metal oxide is chromium oxide.

15. A method as claimed in claim 1, wherein step (b) is carried out by applying onto the positive electrode active surface the olefinic substance in the form of a dispersion containing said metal oxide as dispersed phase.

16. A method as claimed in claim 15, wherein said dispersion contains from about 20 to about 60% by weight of said metal oxide, based on the total weight of said dispersion.

17. A method as claimed in claim 15, wherein said olefinic substance and said metal oxide are present in said dispersion in substantially equal amounts.

18. A method as claimed in claim 15, wherein said olefinic substance comprises a mixture of an unsaturated fatty acid and an unsaturated vegetable wax forming a flowable paste.

19. A method as claimed in claim 18, wherein said unsaturated fatty acid is oleic acid and said unsaturated vegetable wax is carnauba wax.

20. A method as claimed in claim 19, wherein said metal oxide is chromium oxide and wherein said dispersion contains about 47 wt. % of oleic acid, about 6 wt. % of carnauba wax and about 47 wt. % of chromium oxide.

21. A method as claimed in claim 15, wherein said dispersion is applied onto the positive electrode active surface in an amount such as to form micro-droplets having a size ranging from about 1 to about 5μ.

22. A method as claimed in claim 1, wherein step (c) is carried out by continuously injecting said colloidal dispersion under pressure into said electrode gap, in a direction substantially tangent to said positive electrode active surface.

23. A method as claimed in claim 22, wherein said colloidal dispersion is discharged in the form of jets from a plurality of spaced-apart fluid discharge orifices arranged along a line parallel to the longitudinal axis of said positive electrode.

24. A method as claimed in claim 1, wherein said negative electrodes define a predetermined number of channels each having an equal number of negative electrodes, and wherein step (d) is carried out by sequentially scanning the electrodes of each channel while performing said scanning simultaneously for all said channels, and applying an electrical signal to selected ones of said negative electrodes during scanning to energize same.

25. A method as claimed in claim 24, wherein said electrical signal is a pulse-modulated signal having a pulse duration varying from about 250 nanoseconds to about 4 microseconds.

26. A method as claimed in claim 1, further including the step of removing after step (f) any remaining coagulated colloid from said positive electrode active surface.

27. A method as claimed in claim 1, wherein steps (a) through (f) are repeated several times to define a corresponding number of printing stages each using a coloring agent of different color and to thereby produce several differently colored images of coagulated colloid which are transferred at respective transfer positions onto said substrate in superimposed relation to provide a polychromic image.

28. A method as claimed in claim 27, wherein said printing stages are arranged in tandem relation and wherein said substrate is in the form of a continuous web which is passed through said respective transfer positions for being imprinted with said colored images at said printing stages.

29. A method as claimed in claim 27, wherein said printing stages are arranged around a single roller adapted to bring said substrate into contact with the dots of colored, coagulated colloid of each printing stage, and wherein said substrate is in the form of a continuous web which is partially wrapped around said roller and passed through said respective transfer positions for being imprinted with said colored images at said printing stages.

30. An apparatus for reproducing an image and transferring same onto a substrate, which comprises:

a positive cylindrical electrode having a central longitudinal axis and a passivated surface defining a positive electrode active surface, said positive electrode being formed of an electrolytically inert metal;

means for rotating said positive electrode about the longitudinal axis thereof at a substantially constant speed;

a plurality of negative electrolytically inert electrodes electrically insulated from one another and arranged in rectilinear alignment to define a series of corresponding negative electrode active surfaces disposed in a plane parallel to the longitudinal axis of said positive electrode and spaced from the positive electrode active surface by a constant predetermined gap, said negative electrodes being spaced from one another by a distance at least equal to said electrode gap to prevent edge corrosion of said negative electrodes;

means for coating the positive electrode active surface with an olefinic substance and a metal oxide to form on said surface micro-droplets of olefinic substance containing said metal oxide in an amount to prevent corrosion of said positive electrode;

means for filling said electrode gap with a substantially liquid colloidal dispersion containing an electrolytically coagulable colloid, a liquid dispersing medium, a soluble electrolyte and a coloring agent, and having a substantially constant temperature;

means for electrically energizing selected ones of said negative electrodes to cause point-by-point selective coagulation and adherence of the colloid onto the olefin and metal oxide-coated positive electrode active surface opposite the electrode active surfaces of said energized negative electrodes while said positive electrode is rotating, thereby forming a series of corresponding dots of colored, coagulated colloid representative of a desired image;

means for removing any remaining non-coagulated colloid from said positive electrode active surface; and means for bringing a substrate into contact with the dots of colored, coagulated colloid at a transfer station to cause transfer of the colored, coagulated colloid onto said substrate and thereby imprint said substrate with said image.

31. An apparatus as claimed in claim 30, wherein said electrolytically inert metal is selected from the group consisting of stainless steel, platinum, chromium, nickel aluminum and tin.

32. An apparatus as claimed in claim 30, wherein said positive electrode comprises a pliable sheet of electrolytically inert metal having a passive surface layer and extending on a tubular support member having a cylindrical surface, said metal sheet being held in tight contact engagement with the surface of said support member to conform therewith and thereby have a surface of cylindrical configuration defining said positive electrode active surface.

33. A method as claimed in claim 32, wherein said metal sheet is made of stainless steel.

34. An apparatus as claimed in claim 30, wherein said negative electrodes are arranged in at least one elongated head along the length thereof, said head having a longitudinal axis and being rotatable about the longitudinal axis thereof for moving said negative electrodes between a first position whereat said negative electrode active surfaces are spaced from said positive electrode active surface by said constant predetermined gap and a second position whereat said negative electrode active surfaces are exposed to permit cleaning thereof.

35. An apparatus as claimed in claim 34, further including means for cleaning said negative electrode active surfaces when said negative electrodes are in said second position.

36. An apparatus as claimed in claim 34, wherein there are two said heads arranged in juxtaposed relation to one another.

37. An apparatus as claimed in claim 30, wherein said electrode gap ranges from about $50\mu$ to about $100\mu$.

38. An apparatus as claimed in claim 37, wherein said electrode gap is of the order of $50\mu$.

39. An apparatus as claimed in claim 30, wherein said negative electrodes are spaced from one another by a distance equal to said electrode gap.

40. An apparatus as claimed in claim 30, wherein said negative electrodes are spaced from one another by a distance greater than said electrode gap.

41. An apparatus as claimed in claim 38, wherein said negative electrodes are spaced from one another by a distance of about $75\mu$.

42. An apparatus as claimed in claim 30, wherein said means for coating said positive electrode active surface comprises a first roller provided with a plurality of radially extending strips of cloth-like material adapted to contact said positive electrode active surface, means for applying a predetermined amount of a dispersion containing said olefinic substance and said metal oxide onto said strips to coat same, and drive means for rotating said first roller to cause said coated strips to impinge upon said positive electrode active surface such as to transfer thereon said dispersion and thereby form said micro-droplets.

43. An apparatus as claimed in claim 42, wherein said strips of cloth-like material are made of chamois leather.

44. An apparatus as claimed in claim 42, wherein said means for applying said dispersion comprises a second roller arranged in spaced-apart parallel relation to said first roller such as to contact the strips thereof, said second roller being partially immersed in a bath containing said dispersion and being formed with a plurality of longitudinally extending grooves adapted to be filled with said dispersion, means for removing excess dispersion from said second roller, and further drive means for rotating said second roller in said dispersion whereby the grooves thereon are filled with said dispersion and said dispersion is transferred to said strips to coat same.

45. An apparatus as claimed in claim 44, wherein said means for removing excess dispersion comprises an idler roller extending parallel to said second roller and in rotating contact therewith.

46. An apparatus as claimed in claim 44, wherein said further drive means comprises a variable speed motor for varying the speed of rotation of said second roller to thereby vary the amount of dispersion applied onto the strips of said first roller.

47. An apparatus as claimed in claim 30, wherein said means for coating said positive electrode active surfaces comprises a rotatable brush provided with a plurality of radially extending bristles having extremities contacting said positive electrode active surface, means for applying a predetermined amount of a dispersion containing said olefinic substance and said metal oxide onto said bristles to coat the extremities thereof, and drive means for rotating said brush to cause said coated bristles to transfer said dispersion onto said positive electrode active surface and thereby form said micro-droplets.

48. An apparatus as claimed in claim 47, wherein said bristles are made of horsehair.

49. An apparatus as claimed in claim 47, wherein said means for applying said dispersion comprises a roller arranged in spaced-apart parallel relation to said brush such as to contact the bristles thereof at their extremities, said roller being partially immersed in a bath containing said dispersion and being formed with a plurality of longitudinally extending grooves adapted to be filled with said dispersion, means for removing excess dispersion from said roller, and further drive means for rotating said roller in said dispersion whereby the grooves thereon are filled with said dispersion and said dispersion is transferred to said bristles to coat same.

50. An apparatus as claimed in claim 49, wherein said means from removing excess dispersion comprises an idler roller extending parallel to said roller and in rotating contact therewith.

51. An apparatus as claimed in claim 49, wherein said further drive means comprises a variable speed motor for varying the speed of rotation of said roller to thereby vary the amount of dispersion applied onto the bristles of said brush.

52. An apparatus as claimed in claim 30, wherein said means for filling said electrode gap with said colloidal dispersion comprises means for continuously injecting said colloidal dispersion under pressure into said electrode gap, in a direction substantially tangent to said positive electrode active surface.

53. An apparatus as claimed in claim 52, wherein said colloidal dispersion injecting means is provided with a plurality of spaced-apart fluid discharge orifices for discharging said colloidal dispersion in the form of jets, said fluid discharge orifices being arranged along a line parallel to the longitudinal axis of said positive electrode.

54. An apparatus as claimed in claim 52, further including means for collecting the non-coagulated colloid removed by said removing means, and means for recirculating the collected non-coagulated colloid back to said colloidal dispersion injecting means.

55. An apparatus as claimed in claim 30, wherein said negative electrodes define a predetermined number of channels each having an equal number of negative electrodes, and wherein said means for electrically energizing selected ones of said negative electrodes includes electronic circuitry means for sequentially scanning the electrodes of each channel while performing said scanning simultaneously for all said channels, and for applying an electrical signal to selected ones of said negative electrodes during scanning to energize same.

56. An apparatus as claimed in claim 55, wherein said electrical signal is a pulse-modulated signal having a pulse duration varying from about 250 nanoseconds to about 4 microseconds.

57. An apparatus as claimed in claim 30, further including means for removing any remaining coagulated colloid from said positive electrode active surface after transfer of said dots of colored, coagulated colloid onto said substrate.

58. An apparatus as claimed in claim 30, wherein said negative and positive electrodes, said means for coating said positive electrode active surface, said means for filling said electrode gap with said colloidal dispersion and said means for removing said non-coagulated colloid are arranged to define a printing unit, and wherein there are several said printing units each using a coloring agent of different color whereby to produce several differently colored images of coagulated colloid which are transferred at respective transfer stations onto said substrate in superimposed relation to provide a polychromic image.

59. An apparatus as claimed in claim 58, wherein said printing units are arranged in tandem relation and comprise respective means for bringing said substrate into contact with the dots of colored, coagulated colloid at said respective transfer stations, and wherein said substrate is in the form of a continuous web and said means for bringing the web into contact with the dots of colored, coagulated colloid at a transfer station comprises an elongated pressure roller extending parallel to the positive electrode, means for pressing said pressure roller against the positive electrode to form a nip through which said web is passed, and means for rotating said pressure roller and said positive electrode in register.

60. An apparatus as claimed in claim 58, wherein said substrate is in the form of a continuous web and said means for bringing the web into contact with the dots of colored, coagulated colloid at said respective transfer stations comprises a single roller around which said printing units are arranged with the positive electrode of each printing unit extending parallel to said single roller, means for urging each positive electrode against said single roller to form a nip through which said web is passed such as to be partially wrapped around said single roller, and means for rotating said single roller and each said positive electrode in register.

61. An apparatus as claimed in claim 60, wherein said single roller has a central longitudinally extending shaft and wherein said means for rotating said single roller and each said positive electrode in register comprises drive means connected to one end of said shaft for driving same and coupling means interconnecting the other end of said shaft with each said positive electrode for transmitting motion thereto.

62. An apparatus as claimed in claim 61, wherein said coupling means comprises gear means.

63. An apparatus as claimed in claim 61, wherein said single roller and each said positive electrode extend vertically and wherein said single roller is mounted between a pair of opposite horizontally extending plate members and each said positive electrode is mounted between a pair of opposite horizontally extending elongated arms each pivotally connected at one end to a respective plate member.

64. An apparatus as claimed in claim 63, wherein said means for urging each said positive electrode against said single roller comprises hydraulic means connected between the other end of each said arm and said respective plate member.

65. An apparatus as claimed in claim 63, wherein said means for removing said non-coagulated colloid from the positive electrode active surface of each said positive electrode comprises a vertically extending roller provided with a plurality of elongated blade members of resilient material extending longitudinally of the roller and arranged in spaced-apart relationship therearound such one of said blade members is positioned to contact said positive electrode active surface, and means for intermittently rotating said roller to move said one blade member to a non-contact position while replacing same by an adjacent blade member to contact said positive electrode active surface.

* * * * *

UNITED STATES PATENT AND TRADEMARK OFFICE

CERTIFICATE OF CORRECTION

PATENT NO. : 4,895,629

DATED : January 23, 1990

INVENTOR(S) : A. CASTEGNIER et al

It is certified that error appears in the above-identified patent and that said Letters Patent is hereby corrected as shown below:

On the title page: Item [54] and Col. 1, line 1, delete "Speed" and insert --High-Speed--.

Column 3, lines 64-65, delete "support".

Column 4, line 36, after "tin" insert a comma (,).

Column 8, line 62, delete "10".

Column 18, line 18, after "in" insert --rectilinear alignment to define a series of corresponding--.

Column 21, line 34, delete "A method" and insert --An apparatus--.

Signed and Sealed this

Twenty-fifth Day of June, 1996

Bruce Lehman

*Attest:*

BRUCE LEHMAN

*Attesting Officer*

*Commissioner of Patents and Trademarks*